US011085258B2

(12) United States Patent
Hutchinson et al.

(10) Patent No.: US 11,085,258 B2
(45) Date of Patent: Aug. 10, 2021

(54) SYSTEMS, METHODS, AND COMPUTER-READABLE MEDIA TO MONITOR AND CONTROL WELL SITE DRILL CUTTINGS TRANSPORT

(71) Applicant: NATIONAL OILWELL DHT, L.P., Houston, TX (US)

(72) Inventors: Mark W. Hutchinson, Spring, TX (US); William L. Koederitz, Cedar Park, TX (US); Christopher J. Jeffery, Aberdeen (GB); Brad Applewhite, Houston, TX (US)

(73) Assignee: National Oilwell DHT, L.P., Houston, TX (US)

( * ) Notice: Subject to any disclaimer, the term of this patent is extended or adjusted under 35 U.S.C. 154(b) by 0 days.

(21) Appl. No.: 16/305,128

(22) PCT Filed: May 31, 2016

(86) PCT No.: PCT/US2016/035017
§ 371 (c)(1),
(2) Date: Nov. 28, 2018

(87) PCT Pub. No.: WO2017/209730
PCT Pub. Date: Dec. 7, 2017

(65) Prior Publication Data
US 2020/0325741 A1 Oct. 15, 2020

(51) Int. Cl.
*E21B 21/08* (2006.01)
*E21B 44/06* (2006.01)
(Continued)

(52) U.S. Cl.
CPC ..... *E21B 21/08* (2013.01); *E21B 44/06* (2013.01); *E21B 47/04* (2013.01); *E21B 47/06* (2013.01)

(58) Field of Classification Search
CPC ..... E21B 21/08
See application file for complete search history.

(56) References Cited

U.S. PATENT DOCUMENTS

2005/0104184 A1 9/2005 Gleitman
2007/0151762 A1 7/2007 Reitsma
(Continued)

OTHER PUBLICATIONS

Written Opinion issued in corresponding International Application No. PCT/US2016/035017 dated Aug. 18, 2016.
(Continued)

*Primary Examiner* — Giovanna Wright
(74) *Attorney, Agent, or Firm* — Blank Rome LLP

(57) ABSTRACT

Systems, methods, computer-readable media having computer programs, and electronic interfaces to detect and mitigate drill cuttings build-up in borehole drilling for hydrocarbon wells are provided. Embodiments include determining annular pressure at downhole sensors when pumping a drilling fluid into the borehole. Then one or more measures of a decrease in pressure in the borehole between a first sensor and a second sensor that is attributable to build-up of drill cuttings between the first sensor and the second sensor can be determined. Portions of effective density of the drilling fluid that are attributable to build-up of drill cuttings between the sensors also can be determined. Drill cuttings and fluid flow in an interval of the borehole between the first sensor and the second sensor can be analyzed. Whether drill cuttings limit fluid flow in an interval of the borehole between the first sensor and the second sensor then can be determined.

20 Claims, 17 Drawing Sheets

(51) Int. Cl.
*E21B 47/04* (2012.01)
*E21B 47/06* (2012.01)

(56) References Cited

U.S. PATENT DOCUMENTS

| | | | |
|---|---|---|---|
| 2013/0008647 | A1 | 1/2013 | Dirksen et al. |
| 2013/0054146 | A1 | 2/2013 | Rasmus et al. |

OTHER PUBLICATIONS

International Search Report issued in corresponding International Application No. PCT/US2016/035017 dated Aug. 18, 2016.

SYSTEMS, METHODS, AND COMPUTER-READABLE MEDIA TO MONITOR AND CONTROL WELL SITE DRILL CUTTINGS TRANSPORT

CROSS REFERENCE TO RELATED APPLICATIONS

This application is a 35 U.S.C. 371 National Stage of International Application No. PCT/US2016/035017, titled "SYSTEMS, METHODS, AND COMPUTER-READABLE MEDIA TO MONITOR AND CONTROL WELL SITE DRILL CUTTINGS TRANSPORT", filed on May 31, 2016, which is incorporated by reference herein in its entirety.

FIELD OF INVENTION

Embodiments of the invention relate to hydrocarbon well drilling and, more specifically, to systems, methods, computer-readable media having computer programs, and electronic interfaces to monitor and control well site drillings transport and build-up.

BACKGROUND

In the field of oil and gas exploration, the preparation for and drilling of a hydrocarbon well may include the use of computer models. For example, various computer models may predict hydraulic viscous forces and cuttings transport in the wellbore, using differing assumptions about borehole geometry and fluid rheology. Some well-planning models may calculate predicted hydraulics along a wellbore, downhole pressures, and hole cleaning, for instance. Operators sometimes also may use torque and drag models in conjunction with surface torque and hookload measurements to estimate wellbore friction as a way of monitoring hole cleaning and cuttings transport. Such predictions regarding hydraulics and cuttings transport may not be totally reliable, however, and typically need some calibration from actual pressure and flow measurements.

In addition, the transportation of cuttings in horizontal sections of a wellbore, in particular, may be poorly predicted and may result in poor hole cleaning with excessive friction, downhole vibration, stuck pipe, or even borehole instability. Moreover, actual drilling is never quite as predicted.

SUMMARY

Applicant has recognized problems associated with build-up of drill cuttings in a borehole and associated models and advantageously provides systems, methods, computer-readable media having computer programs, and electronic interfaces to address some of these problems. Applicant has also identified needs for enhanced systems, methods, computer-readable media having computer programs, and electronic interfaces to solve these problems. For example, embodiments of the present invention can enable the monitoring of cuttings transport along each wellbore section between distributed downhole annular pressure sensors. This monitoring capability can enable a driller or automated drilling control to identify where poor hole cleaning is occurring and take timely remedial action to avoid potential stuck pipe, tool failures, or borehole instability. More specifically, embodiments can enable identification of changes in the incremental pressure required to circulate fluid between each downhole sensor in relation to the clean fluid density as an indication that the annulus of that hole section has become loaded with or restricted by cuttings. This knowledge in real-time can enable a driller and/or automation controls to detect cuttings build-up, initiate various remedial actions, and prevent potentially costly stuck pipe events.

Embodiments of the invention can use a surface fluid density measurement combined with downhole pressure measurements from two or more annular sensors to determine both the cuttings load and the pressure loss due to cuttings build-up in the section of a wellbore between the sensors. Observed indicators of the cuttings load and the pressure loss due to cuttings build-up in the section of a wellbore between the sensors can be compared to prior predictions or to observations in other sections of the wellbore. If there is a divergence between the predictions and the observed values and/or between sections of the wellbore, steps to mitigate the drillings build-up or loss in pressure can be taken. Advantageously, embodiments of the invention can provide useful, meaningful data without requiring pressure measurements both when circulating and not circulating from all downhole sensors to determine the pressure loss between sensors. Further, embodiments of the invention can provide intelligence regarding the state of fluid flow and cuttings build-up without requiring a downhole measurement of pressure at the bottom-hole assembly.

Embodiments of the invention, for example, can include systems, methods, computer-readable media, and interfaces. For example, an embodiment of the invention can include a system to detect and mitigate drill cuttings build-up in borehole drilling for hydrocarbon wells. Such a system can include one or more processors, as well as two or more sensors in communication with the one or more processors. The two or more sensors can be positioned in a borehole for a hydrocarbon well extending from a surface into a subsurface. A first sensor of the two or more sensors can be positioned downhole from a second sensor of the two or more sensors in the borehole. A system also can include non-transitory computer-readable medium in communication with the one or more processors and having one or more computer programs stored therein that, when executed by the one or more processors, cause the system to perform certain actions. For example, a system can determine, when pumping a drilling fluid into the borehole, a first pressure value at the first sensor and a second pressure value at the second sensor. A system also can determine one or more of: (i) a first decrease in pressure in the borehole between the first sensor and the second sensor that is attributable to build-up of drill cuttings between the first sensor and the second sensor thereby defining a first equivalent cuttings pressure loss responsive to: a true vertical depth value of each of the first sensor and the second sensor, a measured depth value of each of the first sensor and the second sensor, the first pressure value, the second pressure value, and a mud weight of the drilling fluid; (ii) a second decrease in pressure in the borehole between the first sensor and the second sensor that is attributable to build-up of drill cuttings between the first sensor and the second sensor thereby defining a second equivalent cuttings pressure loss responsive to: the true vertical depth value of each of the first sensor and the second sensor, the measured depth value of each of the first sensor and the second sensor, the first pressure value, the second pressure value, and the mud weight; and (iii) a third decrease in pressure in the borehole between the first sensor and the second sensor that is attributable to build-up of drill cuttings between the first sensor and the second sensor thereby defining a third equivalent cuttings pressure loss responsive to: the true vertical depth value of each of the first sensor and the second sensor, the measured depth value of each of the first sensor and the second sensor, the first pressure value, the second pressure value, the mud weight, and a flow-in rate. A system also can determine that drill cuttings limit fluid flow in an interval of the borehole between the first sensor and the second sensor responsive to determining one or more of the first equivalent cuttings pressure loss, the second equivalent cuttings pressure loss, and the third equivalent cuttings pressure loss.

Embodiments also can include methods to detect and mitigate drill cuttings build-up in borehole drilling for hydrocarbon wells. A method according to an embodiment can include, for example, providing a drill cuttings monitor application to a user on a user computing device. A method also can include receiving measurements at a server from two or more sensors positioned in a borehole for a hydrocarbon well extending from a surface into a subsurface. A first sensor of the two or more sensors can be positioned downhole from a second sensor of the two or more sensors in the borehole. The server can include one or more processors and a memory that stores the user's preferences for information format. Further, the one or more processors can operate to perform certain actions. For instance, the processors can operate to determine, responsive to the received measurements taken when pumping a drilling fluid into the borehole, a first pressure value at the first sensor and a second pressure value at the second sensor. The processors also can determine one or more of: (i) a first decrease in pressure in the borehole between the first sensor and the second sensor that is attributable to build-up of drill cuttings between the first sensor and the second sensor thereby defining a first equivalent cuttings pressure loss responsive to: a true vertical depth value of each of the first sensor and the second sensor, a measured depth value of each of the first sensor and the second sensor, the first pressure value, the second pressure value, and a mud weight of the drilling fluid; (ii) a second decrease in pressure in the borehole between the first sensor and the second sensor that is attributable to build-up of drill cuttings between the first sensor and the second sensor thereby defining a second equivalent cuttings pressure loss responsive to: the true vertical depth value of each of the first sensor and the second sensor, the measured depth value of each of the first sensor and the second sensor, the first pressure value, the second pressure value, and the mud weight; and (iii) a third decrease in pressure in the borehole between the first sensor and the second sensor that is attributable to build-up of drill cuttings between the first sensor and the second sensor thereby defining a third equivalent cuttings pressure loss responsive to: the true vertical depth value of each of the first sensor and the second sensor, the measured depth value of each of the first sensor and the second sensor, the first pressure value, the second pressure value, the mud weight, and a flow-in rate. The processors also can operate to determine that drill cuttings limit fluid flow in an interval of the borehole between the first sensor and the second sensor responsive to determining one or more of the first equivalent cuttings pressure loss, the second equivalent cuttings pressure loss, and the third equivalent cuttings pressure loss. Further, the processors can operate to generate a drill cuttings alert from the one or more of the first equivalent cuttings pressure loss, the second equivalent cuttings pressure loss, and the third equivalent cuttings pressure loss. The processors also can operate to format the drill cuttings alert according to the information format and transmit the formatted drill cuttings alert to the user computing device and thereby detect and mitigate drill cuttings build-up in the interval.

BRIEF DESCRIPTION OF DRAWINGS

These and other features, aspects, and advantages of the present invention will become better understood with regard to the following descriptions, claims, and accompanying drawings. It is to be noted, however, that the drawings illustrate only several embodiments of the invention and, therefore, are not to be considered limiting of the invention's scope as it can admit to other equally effective embodiments.

DETAILED DESCRIPTION

So that the manner in which the features and advantages of the embodiments of systems, methods, computer-readable media having computer programs, and electronic interfaces of the present invention, as well as others, which will become apparent, may be understood in more detail, a more particular description of the embodiments of systems, methods, computer-readable media having computer programs, and electronic interfaces of the present invention briefly summarized above may be had by reference to the embodiments thereof, which are illustrated in the appended drawings, which form a part of this specification. It is to be noted, however, that the drawings illustrate only various embodiments of the embodiments of systems, methods, computer-readable media having computer programs, and electronic interfaces of the present invention and are therefore not to be considered limiting of the embodiments of systems, methods, computer-readable media having computer programs, and electronic interfaces of the present invention's scope as it may include other effective embodiments as well.

Figure 1:
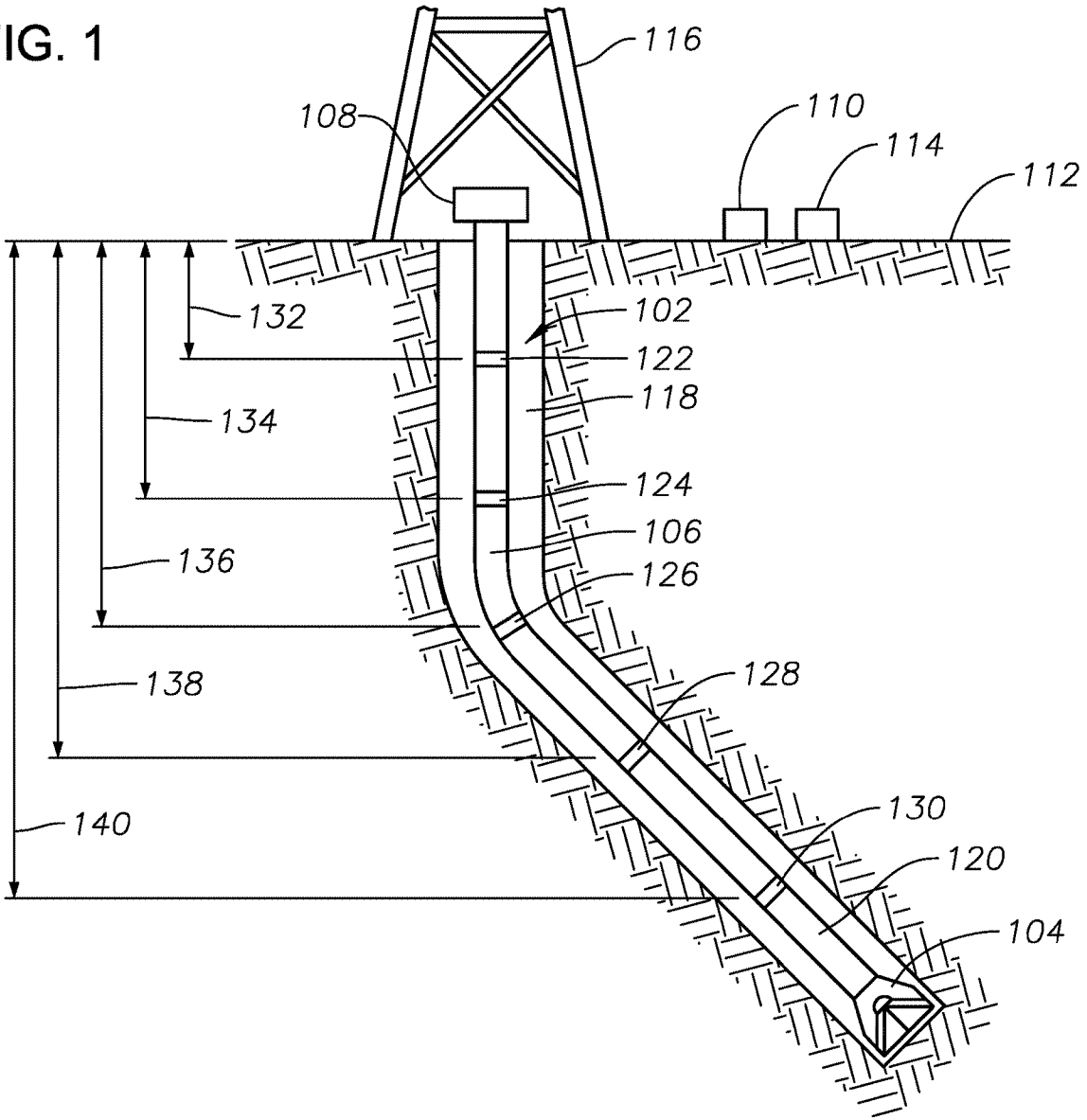
FIG. 1 is a schematic diagram of a system according to an embodiment of the invention.

Embodiments of the invention, for example, can include systems, methods, computer-readable media having computer programs, and electronic interfaces to detect and mitigate drill cuttings build-up in borehole drilling for hydrocarbon wells. A system according to an embodiment, for example, can include a borehole 102 positioned in a subsurface that is being drilled for a hydrocarbon well, as illustrated in FIG. 1, for instance. A borehole 102 can be a substantially cylindrical void created by drilling into subsurface material to access a hydrocarbon formation, for example, thereby to create a hydrocarbon well. In addition to a borehole 102, a system according to an embodiment can include a drill string assembly. A drill string assembly, as illustrated in FIG. 1, for example, can include a drill bit 104, a drill string 106 connected to the drill bit 104, and a motor 108 connected to the drill string 106. The drill bit 104 and the drill string 106 can be positioned within the borehole 102, as depicted in FIG. 1, for example. The drill string assembly further can include a bottom-hole assembly (BHA) 120. The drill string 106 also can be positioned to transmit drilling fluid and torque from the motor 108 at a drilling rig 116 to the drill bit 104 when positioned within the borehole 102. The drill string 106 can include a plurality of substantially cylindrical pipe segments connected to one another that have an approximate radius smaller than an approximate radius of the borehole 102. Consequently, a void can exist between outer surfaces of the drill string 106 and walls of the borehole 102. Such a void can be an annulus 118 of the borehole 102. The drill string 106 can include wired drill pipe, for example. After drilling fluid has been transmitted into the borehole 102 through the drill string 106 to the drill bit 104, the drilling fluid can flow uphole (that is, along the borehole in the direction of the surface) through the annulus 118 to transport drill cuttings away from the drill bit 104.

Figure 14:
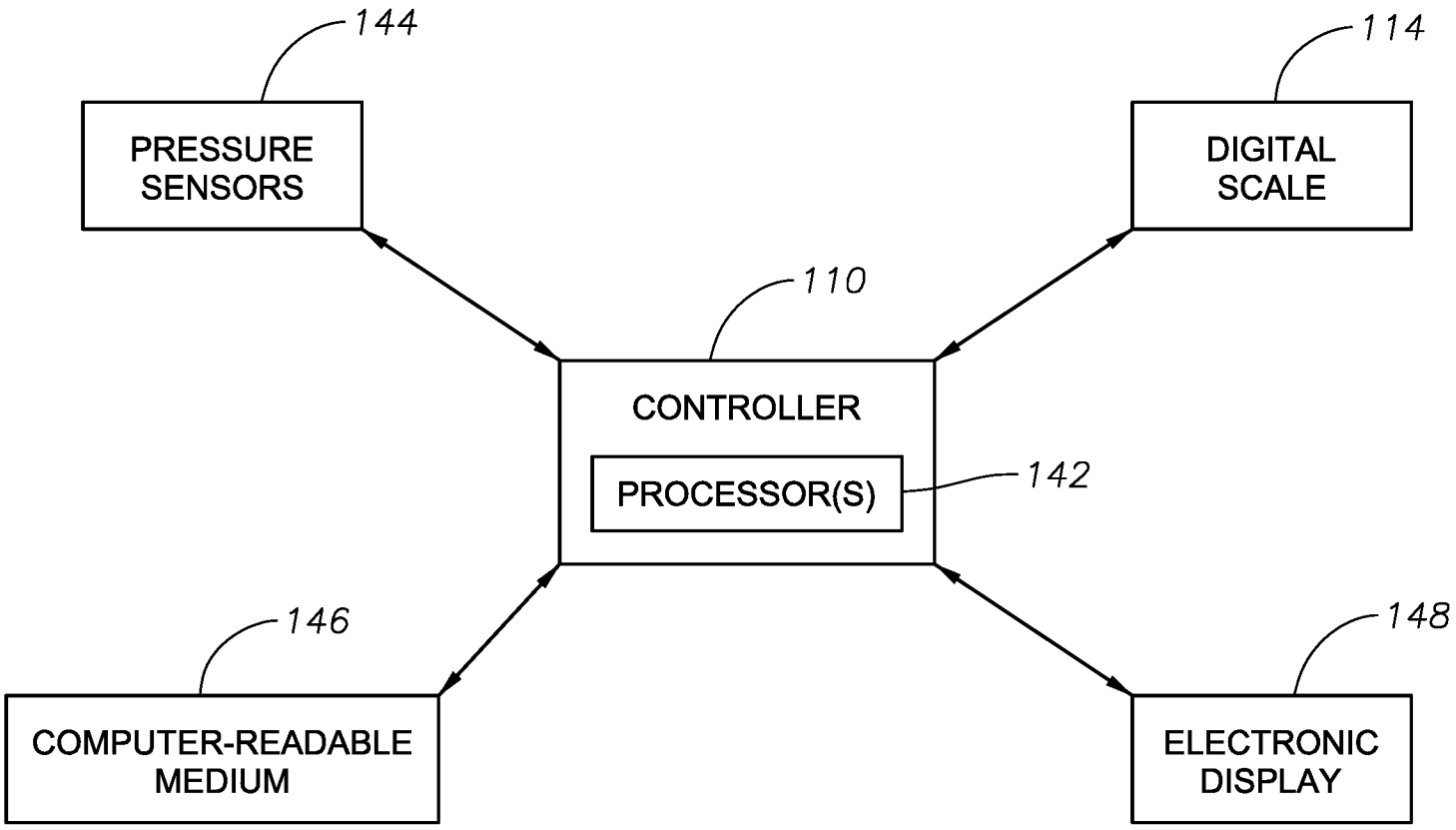
FIG. 14 is a schematic diagram of a system according to an embodiment of the invention.

A system further can include a controller 110 that in turn can include one or more processors 142 positioned at a surface 112 of the borehole to control operations of the drill string assembly, as illustrated in FIG. 1 and FIG. 14, for example. Additionally, a system can include pressure sensors positioned in the borehole 102 and in communication with the controller 110. Multiple sensors that measure downhole pressure, acceleration, and rotation can be distributed within a borehole 102. For example, a system can include annular pressure sensors 144 (that is, sensors configured to measure pressure in the annulus 118) in communication with the controller 110 and positioned along outer surfaces of the drill string 106 in the borehole 102. Further, a first annular pressure sensor can be positioned downhole from a second annular pressure sensor in the borehole 102. That is, the first annular pressure sensor can be nearer to the drill bit 104 than the second annular pressure sensor along the borehole 102. Pressure sensors depicted in FIG. 1 include sensor 122, sensor 124, sensor 126, sensor 128, and sensor 130. An exemplary first annular pressure sensor can be sensor 130, and an exemplary second annular pressure sensor can be sensor 128 because sensor 130 is positioned downhole from sensor 128. In another example, sensor 126 can be a first annular pressure sensor, and sensor 124 can be a second annular pressure sensor. In yet another example, sensor 128 can be a first annular pressure sensor, and sensor 126 can be a second annular pressure sensor. In still yet another example, sensor 130 can be a first annular pressure sensor, and sensor 126 can be a second annular pressure sensor. In the following description of FIG. 1, sensor 128 is described as a first annular pressure sensor, and sensor 126 is described as a second annular pressure sensor. It is to be understood, however, that a first annular pressure sensor and a second annular pressure sensor could be any pair of sensors in which the first annular pressure sensor is downhole from the second annular pressure sensor. In some instances, a system can include a plurality of annular pressure sensors positioned in a linear order in the borehole 102, and each of the first annular pressure sensor 128 and the second annular pressure sensor 126 can be one of the plurality of annular pressure sensors. Further, the first annular pressure sensor 128 and the second annular pressure sensor 126 also can be positioned adjacent one another in the linear order in the borehole 102, as depicted in FIG. 1, for example.

Additionally, a system can include an electronic display 148, as an embodiment of an electronic interface, in communication with the controller 110 to display well data thereon, as illustrated in FIG. 1 and FIG. 14, for example. Such an electronic display 148 can be positioned and located at the surface 112 of the site for the hydrocarbon well or at a remote location. For example, an electronic display 148 can be one or more monitors connected to a computer operated by a driller at the drill site or by another member of a drilling operation team at a remote location. An electronic display 148 also can be a smartphone or other portable electronic device at the drill site or a remote location. A system also can include non-transitory computer-readable medium 146 in communication with the one or more processors 142 of the controller 110. The non-transitory computer-readable medium 146 can have one or more computer programs stored therein that, when executed by the one or more processors 142, can cause the system to perform certain actions.

Such actions can include, for example, determining—for each of the first annular pressure sensor 128 and the second annular pressure sensor 126—an orthogonal distance from the surface 112 to the respective pressure sensor. This distance can define a vertical depth value therebetween. Such a vertical depth value can be termed a true vertical depth (TVD) value, which is a distance from the surface to the respective sensor where the distance is measured at a right angle from the surface, as will be understood by those skilled in the art. For example, a vertical depth value for the first pressure sensor 128 (sometimes represented as $TVD_1$) can be distance 138, as illustrated in FIG. 1. Similarly, a vertical depth value for the second pressure sensor 126 (sometimes represented as $TVD_2$) can be distance 136. Vertical depth values for other sensors can be distance 132 for sensor 122, distance 134 for sensor 124, and distance 140 for sensor 130. A system also can determine, for each of the first annular pressure sensor 128 and the second annular pressure sensor 126, a distance from the surface 112 to the respective pressure sensor along the path of the drill string 106, which thereby can define a measured depth (MD) value therebetween, as will be understood by those skilled in the art. The measured depth value of the first annular pressure sensor 128 is sometimes represented as $MD_1$, and the measured depth value of the second annular pressure sensor 126 is sometimes represented as $MD_2$. A system also can determine a rate at which the drilling fluid is pumped into the borehole 102 through the drill string 106, which thereby can define a flow-in rate, as will be understood by those skilled in the art. Additionally, a system can determine a density of the drilling fluid at the surface 112, which thereby can define a mud weight (sometimes represented as MWΦ).

Further, a system can measure, by the first annular pressure sensor 128 and when pumping the drilling fluid into the borehole 102, a first flowing pressure value (sometimes represented as $AP_{1f}$, where "f" represents "flowing" and 1 denotes the first annular pressure sensor 128). Measured pressure values can be transmitted from a respective pressure sensor to a controller 110 using wired pipe and/or measurement while drilling (MWD), for example. A system also can measure, by the second annular pressure sensor 126 and when pumping the drilling fluid into the borehole 102, a second flowing pressure value (sometimes represented as $AP_{2f}$). A system also can determine a first static pressure value associated with a measurement of pressure at the first annular pressure sensor 128 when pumping of the drilling fluid into the borehole 102 is substantially halted, as well as a second static pressure value associated with a measurement of pressure at the second annular pressure sensor 126 when pumping of the drilling fluid into the borehole 102 is substantially halted. The first static pressure value (sometimes represented as $AP_{1s}$) can be determined by measuring pressure at the first annular pressure sensor 128 when the drilling fluid is not being circulated, or it can be estimated. Likewise, the second static pressure value (sometimes represented as $AP_{2s}$) can be determined by measuring pressure at the second annular pressure sensor 126 when the drilling fluid is not being circulated, or it can be estimated. For example, the second static pressure value can be estimated as mud weight multiplied by a constant representing gravitational acceleration multiplied by the true vertical depth of the second annular pressure sensor 126 (that is, $AP_{2s}=MW\Phi\times g\times TVD_2$). The first static pressure value similarly can be estimated as mud weight multiplied by a constant representing gravitational acceleration multiplied by the true vertical depth of the first annular pressure sensor 128 (that is, $AP_{1s}=MW\Phi\times g\times TVD_1$). Alternatively, the first static pressure value can be estimated as the second static pressure value plus the product of the difference between the true vertical depth value of the first annular pressure sensor 128 and the true vertical depth value of the second annular pressure sensor 126 multiplied by a constant representing gravitational acceleration multiplied by the mud weight (that is, $AP_{1s}=AP_{2s}+MW\Phi\times g\times(TVD_1-TVD_2)$. As a result, determining the second static pressure value can be responsive to the vertical depth value of the second annular pressure sensor 126 and the mud weight, and determining the first static pressure value can be responsive to one of: (i) the second static pressure value, the vertical depth value of each of the first annular pressure sensor 128 and the second annular pressure sensor 126, and the mud weight, or (ii) the vertical depth value of the first annular pressure sensor 128 and the mud weight. Advantageously, static pressure (that is, pressure while pumping is not occurring and drilling fluid is thus static rather than flowing) can be measured at the annular pressure sensors, but embodiments also can allow for one or more of the static pressure values to be estimated instead of being measured directly. Embodiments thus advantageously can reduce the quantity of pressure measurements required to be taken directly.

A system then can determine one or more measures or indicators of any decrease in pressure in the borehole 102 between the first annular pressure sensor 128 and the second annular pressure sensor 126 that is attributable to build-up of drill cuttings between the first annular pressure sensor 128 and the second annular pressure sensor 126. Such decreases can be referred to as equivalent cuttings pressure loss or frictional pressure loss. These indicators can alert a driller to changes in pressure in an interval between two annular pressure sensors that might cause the driller to take remedial actions, such as changing the flow-in rate and/or the fluid properties.

For example, a system can determine a first decrease in pressure in the borehole 102 between the first annular pressure sensor 128 and the second annular pressure sensor 126 that is attributable to build-up of drill cuttings between the first annular pressure sensor 128 and the second annular pressure sensor 126, thereby defining a first equivalent cuttings pressure loss. A first equivalent cuttings pressure loss can be determined responsive to: the vertical depth value of each of the first annular pressure sensor 128 and the second annular pressure sensor 126, the measured depth value of each of the first annular pressure sensor 128 and the second annular pressure sensor 126, the first flowing pressure value, the second flowing pressure value, and the mud weight. For example, a first equivalent cuttings pressure loss can be represented as $PCUT_1$ and can be equal to $(AP_{1f}+(MW\Phi\times g\times TVD_2)-AP_{2f}-(MW\Phi\times g\times TVD_1))/(MD_1-MD_2)$.

In addition, a system can determine a second decrease in pressure in the borehole 102 between the first annular pressure sensor 128 and the second annular pressure sensor 126 that is attributable to build-up of drill cuttings between the first annular pressure sensor 128 and the second annular pressure sensor 126, thereby defining a second equivalent cuttings pressure loss. A second equivalent cuttings pressure loss can be determined responsive to: the vertical depth value of the first annular pressure sensor 128, the measured depth value of each of the first annular pressure sensor 128 and the second annular pressure sensor 128, the first flowing pressure value, the second flowing pressure value, the second static pressure value, and the mud weight. For example, a second equivalent cuttings pressure loss can be represented as YCUT 1 and can be equal to $(AP_{1f}-AP_{2s}-AP_{2f}-(MW\Phi\times g\times TVD_1))/(MD_1-MD_2)$.

Further, a system can determine a third decrease in pressure in the borehole 102 between the first annular pressure sensor 128 and the second annular pressure sensor 126 that is attributable to build-up of drill cuttings between the first annular pressure sensor 128 and the second annular pressure sensor 126 thereby defining a third equivalent cuttings pressure loss responsive to: the measured depth value of each of the first annular pressure sensor 128 and the second annular pressure sensor 126, the first flowing pressure value, the second flowing pressure value, the first static pressure value, the second static pressure value, and the flow-in rate. For example, a third equivalent cuttings pressure loss can be represented as $FRICN_1$ and can be equal to $(AP_{1f}+AP_{2s}-AP_{2f}-AP_{1s})/(MD_1-MD_2)\times$Flow-In. Such a third equivalent cuttings pressure loss thus can take flow-in rate into account. Consequently, such an indicator of pressure loss can utilize surface flow rate to compensate for any changes to the flow that a driller might make, which together with comparing to predicted pressures from a model, can enable the driller to decide when and what changes to make to the fluid properties.

A system then can generate, by the electronic display 148, a graphical representation of one or more of the first equivalent cuttings pressure loss, the second equivalent cuttings pressure loss, and the third equivalent cuttings pressure loss. Further, a system can determine that drill cuttings limit fluid flow in an interval of the borehole 102 between the first annular pressure sensor 128 and the second annular pressure sensor 126 responsive to generating the graphical representation and thereby detect and mitigate drill cuttings build-up in the interval.

It is to be understood that an interval of the borehole 102 can be a portion or section of the borehole 102 or the entire length of the borehole 102 depending on the positions within the borehole 102 of the first annular pressure sensor and the second annular pressure sensor that bound the interval. Further, while an example of an interval bounded by two pressure sensors is given here, an interval of the borehole 102 also can be bounded by the surface 112 and a sensor, for instance.

In some instances, the one or more computer programs, when executed by the one or more processors 142 of the controller 110, further can cause the system to determine one or more indicators of the portion of effective density of the drilling fluid in the borehole 102 between the first annular pressure sensor 128 and the second annular pressure sensor 126 that is attributable to build-up of drill cuttings between the first annular pressure sensor 128 and the second annular pressure sensor 126, that is, an average equivalent density contribution of cuttings load. An average equivalent density contribution of cuttings load indicates the suspended contribution of cuttings to the overall density of the drilling fluid. For example, a system can determine a first portion of effective density of the drilling fluid in the borehole 102 between the first annular pressure sensor 128 and the second annular pressure sensor 126 that is attributable to build-up of drill cuttings between the first annular pressure sensor 128 and the second annular pressure sensor 126, thereby defining a first average equivalent density contribution of cuttings load between the first annular pressure sensor 128 and the second annular pressure sensor 126. A first average equivalent density contribution of cuttings load can be determined responsive to: the first static pressure value, the second static pressure value, the vertical depth value of each of the first annular pressure sensor 128 and the second annular pressure sensor 126, and the mud weight. For example, a first average equivalent density contribution of cuttings load can be represented by $RHO_1$ and can be equal to $(AP_{1s}-AP_{2s})/(g\times(TVD_1-TVD_2))-MW\Phi$.

A system also can determine a second portion of effective density of the drilling fluid in the borehole 102 between the first annular pressure sensor 128 and the second annular pressure sensor 126 that is attributable to build-up of drill cuttings between the first annular pressure sensor 128 and the second annular pressure sensor 126, thereby defining a second average equivalent density contribution of cuttings load between the first annular pressure sensor 128 and the second annular pressure sensor 126. A second average equivalent density contribution of cuttings load can be determined responsive to: the vertical depth value of each of the first annular pressure sensor 128 and the second annular pressure sensor 126, the measured depth value of each of the first annular pressure sensor 128 and the second annular pressure sensor 126, the first static pressure value, the second static pressure value, and the mud weight. For example, a second average equivalent density contribution of cuttings load can be represented by $LOAD_1$ and can be equal to $(AP_{1s}-AP_{2s})-(MW\Phi\times g\times(TVD_1-TVD_2)))/(MD_1-MD_2)$.

Further, a system also can determine additional indicators of any decrease in pressure in the borehole 102 between the first annular pressure sensor 128 and the second annular pressure sensor 126 that is attributable to build-up of drill cuttings between the first annular pressure sensor 128 and the second annular pressure sensor 126. A system can determine, for instance, a fourth decrease in pressure in the borehole 102 between the first annular pressure sensor 128 and the second annular pressure sensor 126 that is attributable to build-up of drill cuttings between the first annular pressure sensor 128 and the second annular pressure sensor 126, thereby defining a fourth equivalent cuttings pressure loss. A fourth equivalent cuttings pressure loss can be determined responsive to: the measured depth value of each of the first annular pressure sensor 128 and the second annular pressure sensor 126, the first flowing pressure value, the second flowing pressure value, the first static pressure value, and the second static pressure value. For example, a fourth equivalent cuttings pressure loss can be represented as $FRIC_1$ and can be equal to $(AP_{1f}+AP_{2s}-AP_{2f}-AP_{1s})/(MD_1-MD_2)$. A system then can generate, by the electronic display 148, a graphical representation of one or more of the first average equivalent density contribution of cuttings load, the second average equivalent density contribution of cuttings load, and the fourth equivalent cuttings pressure loss.

In addition, a system according to an embodiment can determine a predicted average equivalent density contribution of cuttings load for the borehole 102 and a predicted equivalent cuttings pressure loss for the borehole 102. Such predictions can be based on studies of the hydrocarbon formation, analyses and data from drilling other boreholes, or any other relevant information. A system further can determine that drill cuttings limit fluid flow in the interval of the borehole 102 between the first annular pressure sensor 128 and the second annular pressure sensor 126 responsive to (i) a comparison of the predicted average equivalent density contribution of cuttings load for the borehole to one or more of the first average equivalent density contribution of cuttings load and the second average equivalent density contribution of cuttings load and (ii) a comparison of the predicted equivalent cuttings pressure loss for the borehole to one or more of the first equivalent cuttings pressure loss, the second equivalent cuttings pressure loss, the third equivalent cuttings pressure loss, and the fourth equivalent cuttings pressure loss. Still further, a system can generate, by the electronic display 148, a graphical representation of the predicted average equivalent density contribution of cuttings load for the borehole 102 and the predicted equivalent cuttings pressure loss for the borehole 102 with the graphical representation of one or more of the first equivalent cuttings pressure loss, the second equivalent cuttings pressure loss, and the third equivalent cuttings pressure loss and the graphical representation of one or more of the first average equivalent density contribution of cuttings load, the second average equivalent density contribution of cuttings load, and the fourth equivalent cuttings pressure loss. The determined indicators then can be compared to prior predictions to determine whether they diverge from the predictions at step 232. If there is a divergence between the predictions and the observed values, steps to mitigate the drillings build-up or loss in pressure can be taken.

Mud weight can be used in various determinations and calculations according to embodiments. Mud weight can be measured at the surface 112 and/or calculated using measurements from internal pressure sensors in the drill string 106. For example, a system according to an embodiment further can include a first internal pressure sensor in communication with the controller 110 and positioned along inner surfaces of the drill string 106 in the borehole 102. A system also can include a second internal pressure sensor in communication with the controller 110 and positioned along inner surfaces of the drill string 106 in the borehole 102. The first internal pressure sensor can be positioned downhole from the second internal pressure sensor in the drill string 106. Further, such a system can determine, for each of the first internal pressure sensor and the second internal pressure sensor, an orthogonal distance from the surface to the respective pressure sensor thereby defining a vertical depth value therebetween (that is, a true vertical depth (TVD) of the internal pressure sensors). A system then can measure, by the first internal pressure sensor and when pumping of the drilling fluid into the borehole 102 is substantially halted, a first internal pressure value. Additionally, a system can measure, by the second internal pressure sensor and when pumping of the drilling fluid into the borehole 102 is substantially halted, a second internal pressure value. A system then can determine the mud weight responsive to one of: (i) the second internal pressure value and the vertical depth value of the second internal pressure sensor, or (ii) the vertical depth value of each of the first internal pressure sensor and the second internal pressure sensor, the first internal pressure value, and the second internal pressure value. For example, such internal pressure (IP) measurements taken when pumping of the drilling fluid into the borehole 102 is substantially halted (that is, static) can be represented as $IP_{Is}$ for the first internal pressure sensor and $IP_{IIs}$ for the second internal pressure sensor, where "s" represents "static," I denotes the first internal pressure sensor, and II denotes the second internal pressure sensor. Mud weight, as noted above, can be represented by MWΦ and can be equal to $(IP_{IIs}/g \times TVD_{II})$ or to $(IP_{Is}-IP_{IIs})/g \times (TVD_I-TVD_{II})$). Alternatively or in addition to internal pressure sensors, a system can include a digital scale 114 to weigh drilling fluid. The digital scale 114 can be in communication with the controller 110 and positioned at the surface 112, as illustrated in FIG. 1 and FIG. 14, for example. A system can measure, by the digital scale 114, a density of the drilling fluid at the surface 112 thereby to determine the mud weight.

As a result, embodiments of the invention advantageously can use a surface fluid density measurement combined with downhole annular pressure measurements to determine measure of both the cuttings load and the hydraulic frictional pressure loss in the borehole that is attributable to cuttings build-up along the section of a wellbore between the sensors. Further, embodiments can include an application for wired pipe and drilling automation.

Figure 2:
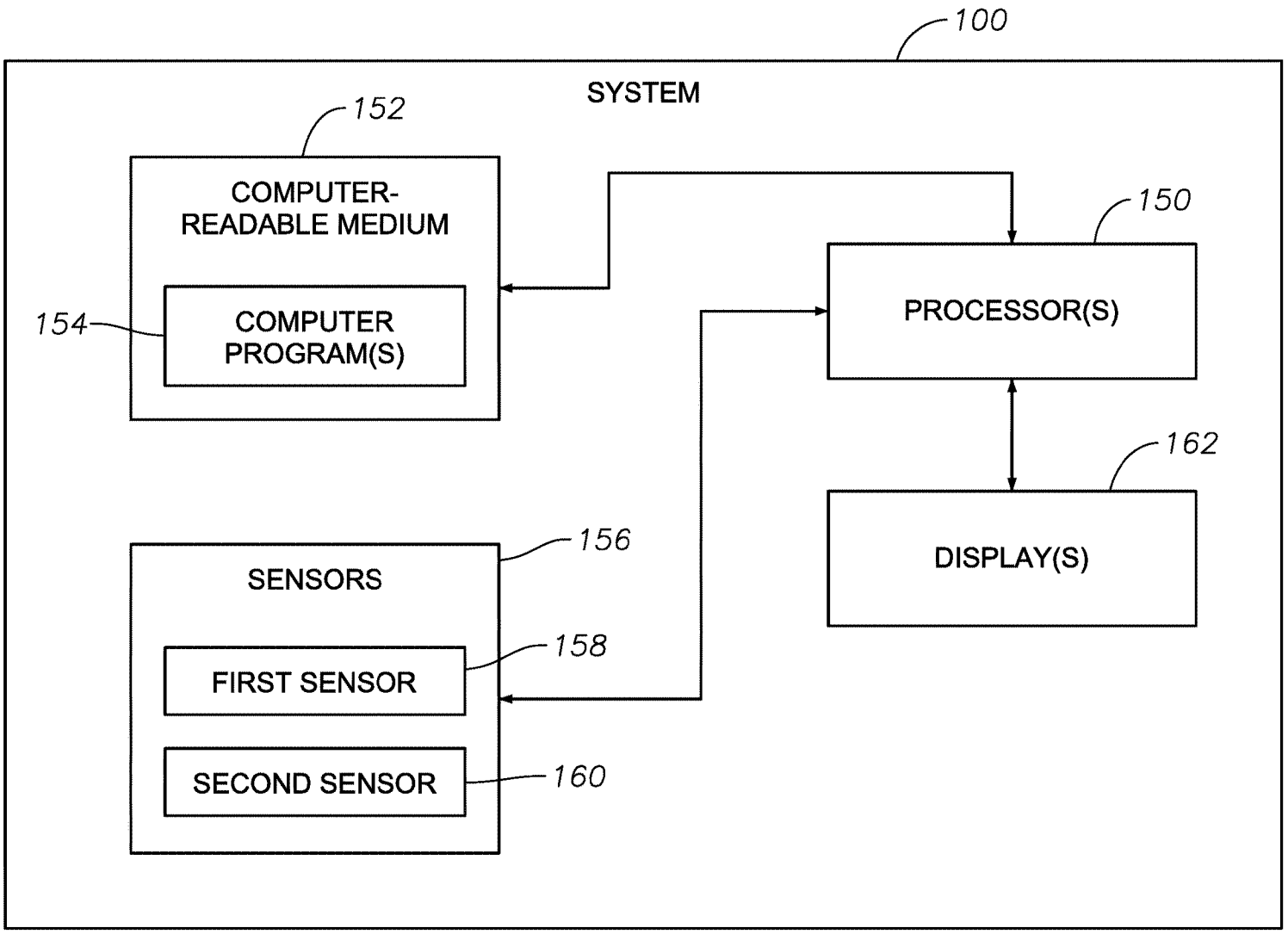
FIG. 2 is a schematic diagram of a system according to an embodiment of the invention.

Another system to detect and mitigate drill cuttings build-up in borehole drilling for hydrocarbon wells according to an embodiment can include one or more processors 150, as illustrated in FIG. 2, for example. Such a system 100 also can include two or more sensors 156 in communication with the one or more processors 150. The two or more sensors 156 can be positioned in a borehole 102 for a hydrocarbon well, and the borehole 102 can extend from a surface 112 into a subsurface. A first sensor 158 of the two or more sensors 156 can be positioned downhole from a second sensor 160 of the two or more sensors 156 in the borehole 102. A system 100 also can include non-transitory computer-readable medium 152 in communication with the one or more processors 150. The non-transitory computer-readable medium 152 can have one or more computer programs 154 stored therein that, when executed by the one or more processors 150, can cause the system 100 to determine, when pumping a drilling fluid into the borehole, a first pressure value at the first sensor 158 and a second pressure value at the second sensor 160. The system 100 then can determine one or more of: a first equivalent cuttings pressure loss, a second equivalent cuttings pressure loss, and a third equivalent cuttings pressure loss. A first equivalent cuttings pressure loss can be a first decrease in pressure in the borehole 102 between the first sensor 158 and the second sensor 160 that is attributable to build-up of drill cuttings between the first sensor 158 and the second sensor 160 and can be determined responsive to a true vertical depth (TVD) value of each of the first sensor 158 and the second sensor 160, a measured depth (MD) value of each of the first sensor 158 and the second sensor 160, the first pressure value, the second pressure value, and a mud weight of the drilling fluid. The system 100 can determine the true vertical depth value of each of the two or more sensors 152. A second equivalent cuttings pressure loss can be a second decrease in pressure in the borehole 102 between the first sensor 158 and the second sensor 160 that is attributable to build-up of drill cuttings between the first sensor 158 and the second sensor 160 and can be determined responsive to: the true vertical depth value of each of the first sensor 158 and the second sensor 160, the measured depth value of each of the first sensor 158 and the second sensor 160, the first pressure value, the second pressure value, and the mud weight. Further, a third equivalent cuttings pressure loss can be a third decrease in pressure in the borehole 102 between the first sensor 158 and the second sensor 160 that is attributable to build-up of drill cuttings between the first sensor 158 and the second sensor 160 and can be determined responsive to: the true vertical depth value of each of the first sensor 158 and the second sensor 160, the measured depth value of each of the first sensor 158 and the second sensor 160, the first pressure value, the second pressure value, the mud weight, and a flow-in rate. The system 100 also can determine that drill cuttings limit fluid flow in an interval of the borehole 102 between the first sensor 158 and the second sensor 160 responsive to determining one or more of the first equivalent cuttings pressure loss, the second equivalent cuttings pressure loss, and the third equivalent cuttings pressure loss.

In some instances, a system 100 further can include one or more displays 162 in communication with the one or more processors 150. Additionally, the one or more computer programs 154, when executed by the one or more processors 150, further can cause the system 100 to generate, by the one or more displays 162, a graphical representation of one or more of the first equivalent cuttings pressure loss, the second equivalent cuttings pressure loss, and the third equivalent cuttings pressure loss as a function of depth and time. Such a graphical representation can enable detection of cuttings build-up or restricted drilling fluid flow in the interval of the borehole 102 between the first sensor 158 and the second sensor 160, which in turn can enable initiation of steps to correct or mitigate the build-up or restricted fluid flow. A system 100 also can generate, by the one or more displays 162, a graphical representation of a caliper of the borehole 102 as a function of depth. Such a graphical representation of the caliper of the borehole 102 can provide additional intelligence regarding the state of cuttings build-up and fluid flow in the borehole 102 to enhance decisions about the mitigation steps to take.

In some circumstances, a system 100 also can determine a predicted equivalent cuttings pressure loss for the borehole 102. Such a prediction can be based on prior experience with the borehole 102 itself, the hydrocarbon formation, or other boreholes or hydrocarbon formations. The system then can generate, by the one or more displays 162, a graphical representation of the predicted equivalent cuttings pressure loss for the borehole 102 with the graphical representation of the one or more of the first equivalent cuttings pressure loss, the second equivalent cuttings pressure loss, and the third equivalent cuttings pressure loss. The system 100 then can determine that drill cuttings limit fluid flow in the interval of the borehole 102 between the first sensor 158 and the second sensor 160 responsive to a comparison of the predicted equivalent cuttings pressure loss for the borehole 102 to one or more of the first equivalent cuttings pressure loss, the second equivalent cuttings pressure loss, and the third equivalent cuttings pressure loss. Generating these graphical representations together can enable comparison of the decrease in pressure in the borehole 102 between the first sensor 158 and the second sensor 160 that is attributable to build-up of drill cuttings in that interval to the prediction. A divergence from the predictions can indicate cuttings build-up or restricted drilling fluid flow in the interval of the borehole 102 between the first sensor 158 and the second sensor 160, in some circumstances. For example, a system 100 can determine that drill cuttings limit fluid flow in the interval of the borehole 102 between the first sensor 158 and the second sensor 160 responsive to a comparison of the predicted equivalent cuttings pressure loss for the borehole 102 to one or more of the first equivalent cuttings pressure loss, the second equivalent cuttings pressure loss, and the third equivalent cuttings pressure loss.

In some instances, embodiments of the invention can enable a comparison of two or more intervals of the borehole 102 to one another to identify problematic or potentially problematic sections. For example, the two or more sensors 156 further can include a third sensor. The second sensor 160 can be positioned downhole from the third sensor. Further, the first sensor 158 and the second sensor 160 can be positioned adjacent each other in the borehole 102 among the two or more sensors 156, and the second sensor 160 and the third sensor can be positioned adjacent each other in the borehole 102 among the two or more sensors 156. For example, as illustrated in FIG. 1, the first sensor 158 can be sensor 130, the second sensor 160 can be sensor 128, and the third sensor can be sensor 126. In this example, an interval of the borehole 102 between sensor 130 and sensor 128 can be compared to an adjacent interval of the borehole 102 between sensor 128 and sensor 126.

The system 100 can determine, when pumping the drilling fluid into the borehole 102, a third pressure value at the third sensor. Further, the system 100 can determine one or more indicators of pressure loss in the interval between the second sensor 160 and the third sensor similar to the determinations made with respect to the interval between the first sensor 158 and the second sensor 160. For example, the system 100 can determine one or more indicators of a decrease in pressure in the borehole 102 between the second sensor 160 and the third sensor that is attributable to build-up of drill cuttings between the second sensor 160 and the third sensor, such as a fourth equivalent cuttings pressure loss, a fifth equivalent cuttings pressure loss, and a sixth equivalent cuttings pressure loss. A fourth equivalent cuttings pressure loss (such as $PCUT_2$) can be determined responsive to: the true vertical depth value of the second sensor 160, a true vertical depth value of the third sensor, the measured depth value of the second sensor 160, a measured depth value of the third sensor, the second pressure value, the third pressure value, and the mud weight A fifth equivalent cuttings pressure loss (such as $YCUT_2$) can be determined responsive to: the true vertical depth value of each of the second sensor 160 and the third sensor, the measured depth value of each of the second sensor 160 and the third sensor, the second pressure value, the third pressure value, and the mud weight. A sixth equivalent cuttings pressure loss (such as $FRICN_2$) can be determined responsive to: the true vertical depth value of each of the second sensor 160 and the third sensor, the measured depth value of each of the second sensor 160 and the third sensor, the second pressure value, the third pressure value, the mud weight, and the flow-in rate. The system 100 can determine that drill cuttings limit fluid flow in the interval of the borehole 102 between the first sensor 158 and the second sensor 160 relative to another interval of the borehole 102 between the second sensor 160 and the third sensor responsive to comparing (i) one or more of the first equivalent cuttings pressure loss, the second equivalent cuttings pressure loss, and the third equivalent cuttings pressure loss to (ii) one or more of the fourth equivalent cuttings pressure loss, the fifth equivalent cuttings pressure loss, and the sixth equivalent cuttings pressure loss.

Embodiments of the invention can compare different sections of the borehole to one another regardless of whether the sections of the borehole are adjacent one another by taking measurements at four sensors. For example, a system 100 also can include a fourth sensor. The third sensor can be positioned downhole from the fourth sensor. Further, the first sensor 158 and the second sensor 160 can be positioned adjacent each other in the borehole 102 among the two or more sensors 156, and the third sensor and the fourth sensor can be positioned adjacent each other in the borehole among the two or more sensors 156. For example, as illustrated in FIG. 1, the first sensor 158 can be sensor 130, the second sensor 160 can be sensor 128, the third sensor can be sensor 126, and the fourth sensor can be sensor 124. In this example, an interval of the borehole 102 between sensor 130 and sensor 128 can be compared to an interval of the borehole 102 between sensor 126 and sensor 124. In another example, the first sensor 158 can be sensor 130, the second sensor 160 can be sensor 128, the third sensor also can be sensor 128, and the fourth sensor can be sensor 126. In this example, an interval of the borehole 102 between sensor 130 and sensor 128 can be compared to an adjacent interval of the borehole 102 between sensor 128 and sensor 126. For example, a system 100 can determine, when pumping drilling fluid into the borehole 102, a fourth pressure value at the fourth sensor and can make similar determinations regarding the interval of the borehole 102 between the third sensor and the fourth sensor to those described above with respect to other intervals of the borehole. The two or more sensors 156 can be positioned in a linear order in the borehole 102 in which the first sensor 158 and the second sensor 160 can be positioned adjacent each other in the linear order and the third sensor and the fourth sensor can be positioned adjacent each other in the linear order. Two or more non-adjacent intervals can be compared to each other, as well, and overlapping intervals also can be compared.

Figure 5:
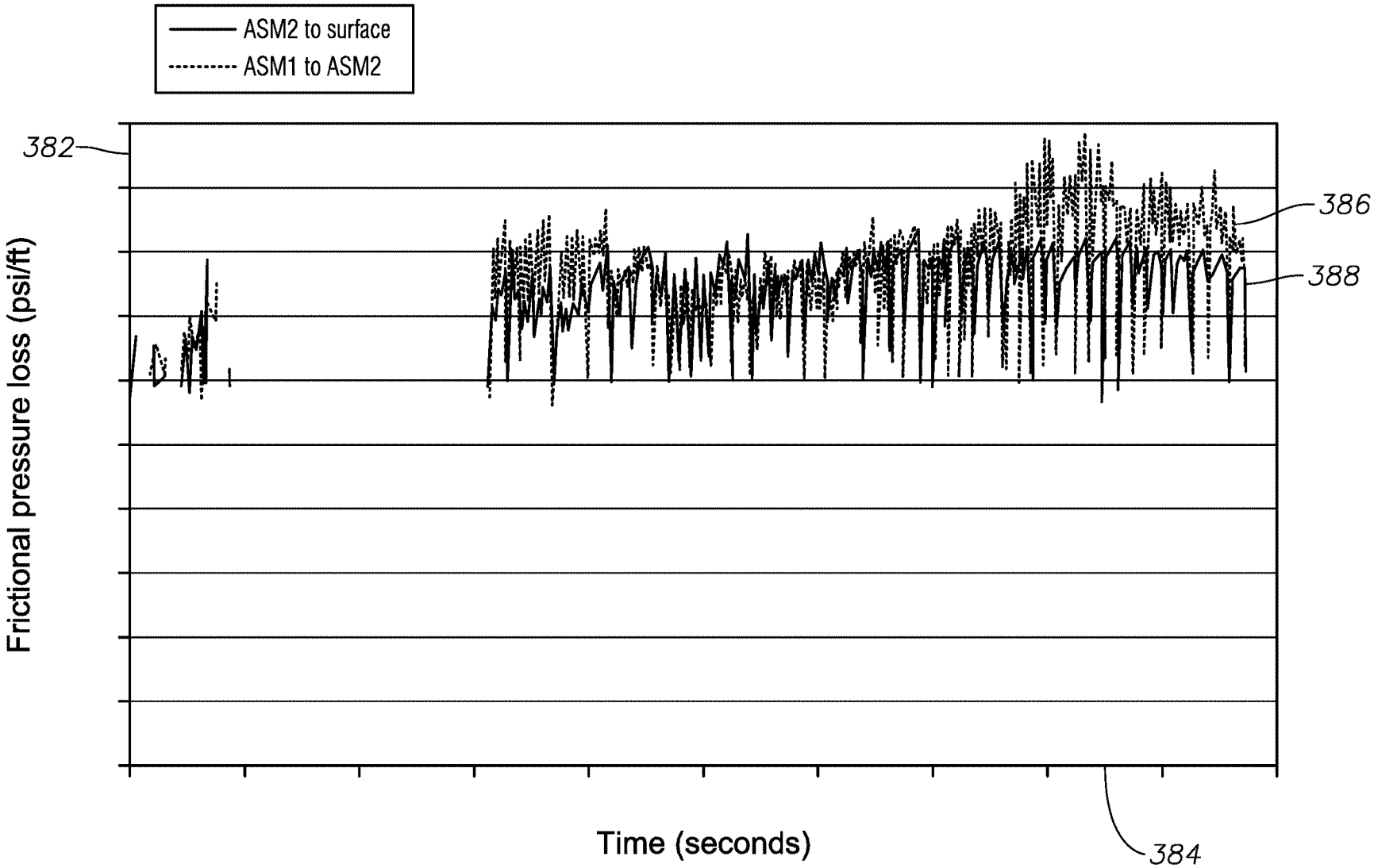
FIG. 5 is a schematic diagram of an interface according to an embodiment of the invention.
Figure 6:
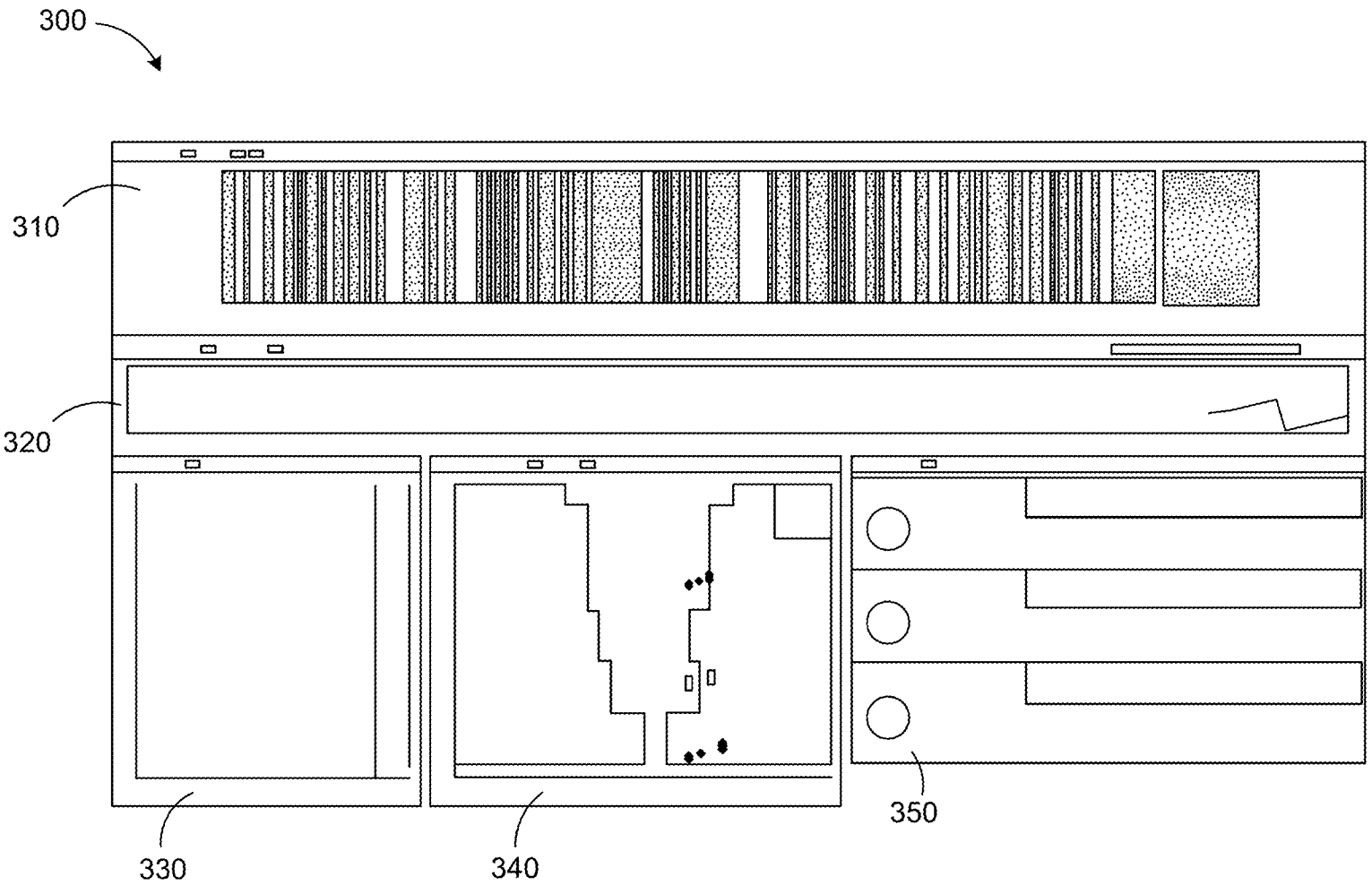
FIG. 6 is a schematic diagram of an interface according to an embodiment of the invention.

In addition to comparing an interval of the borehole 102 between a pair of sensors (such as the first sensor 158 and the second sensor 160) to another interval between a different pair of sensors (such as the third sensor and the fourth sensor), an interval of the borehole 102 between a pair of sensors can be compared to an interval of the borehole 102 between one sensor of the pair and the surface 112. For example, an interval of the borehole 102 between a pair of sensors can be compared to an interval of the borehole 102 between the uphole sensor of the pair and the surface 112. An example of a comparison of the equivalent cuttings pressure loss in the portion of the borehole between the first sensor 158 and the second sensor 160 to the equivalent cuttings pressure loss in a portion of the borehole between the second sensor 160 and the surface 112 is illustrated in FIG. 5, for instance. The graph depicted in FIG. 5 shows time (in seconds) along the x-axis 384 and frictional pressure loss (in pressure per foot) along the y-axis 382. The plotted trend lines, which connect data points at different times, illustrate the pressure per foot required to circulate drilling fluid in two intervals of the borehole 102. For example, trend line 386 illustrates the pressure per foot required to circulate drilling fluid in the portion of the borehole between the first sensor 158 and the second sensor 160. Trend line 388, on the other hand, illustrates the pressure per foot required to circulate drilling fluid in the portion of the borehole between the second sensor 160 and the surface 112. Similarities between the two trend lines, such as where trend line 386 and trend line 388 track each other (including in the middle portion of the graph) can indicate that cuttings transport is uniform. In contrast, divergence between the two trend lines, such as where trend line 386 and trend line 388 separate (including on the right of the graph), potentially can indicate poorer hole cleaning. In some instances, such a divergence between trend line 386 and trend line 388 can be associated with a lateral portion of a borehole 102, for example.

Figure 15:
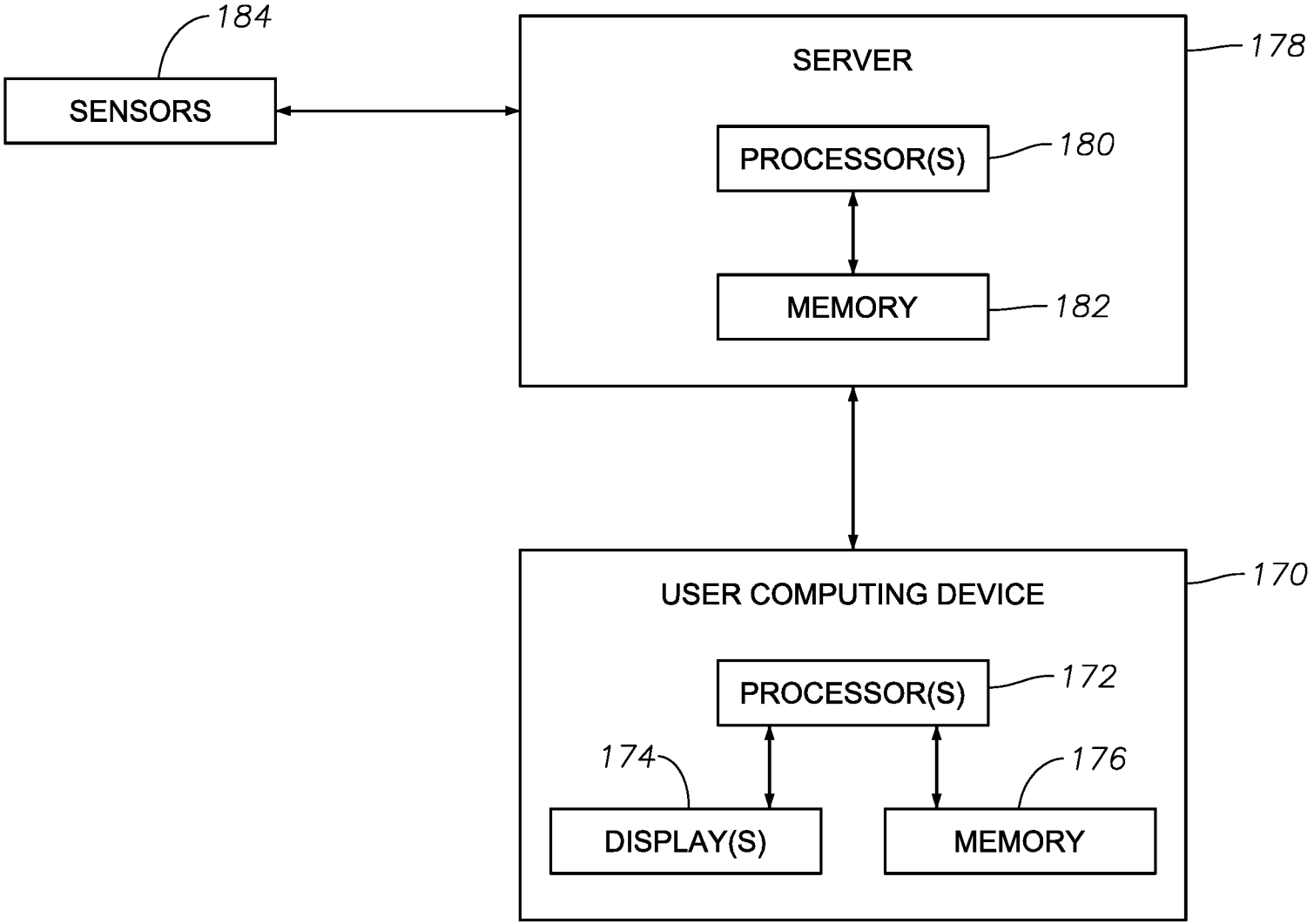
FIG. 15 is a schematic diagram of a system according to an embodiment of the invention.

Embodiments of the invention also can include related methods, non-transitory computer-readable media, and interfaces. For example, a method to detect and mitigate drill cuttings build-up in borehole drilling for hydrocarbon wells can include providing a drill cuttings monitor application to a user on a user computing device 170, as illustrated in FIG. 15, for instance. Such a user computing device 170 can include, for example, a desktop computer, a laptop, a smartphone, a tablet computer, or a personal digital assistant, among other examples. Further, the user computing device 170 can be positioned and located at or near a drilling site, but the user computing device 170 also can be positioned at a remote location, such as an operator's office facility, for example, or at any other location. A user computing device 170 can include, for example, one or more processors 172, one or more displays 174 in communication with the one or more processors 172, and a memory 176 (such as a non-transitory computer-readable medium) in communication with the one or more processors 172

A method also can include receiving measurements at a server 178 from two or more sensors 184 positioned in a borehole for a hydrocarbon well. Such sensors 184 can include annular pressure sensors, for example. The server 178 can be positioned and located at the drilling site, but the server 178 also can be positioned at a remote location, similarly to the user computing device 170. Further, the server 178 and user computer device 170 can be positioned at the same location, either at the drilling site or at a remote site, or the server 178 and the user computer device 170 can be positioned at different locations from each other, including two separate remote locations. The server 178 can include one or more processors 180 and a memory 182 (such as a non-transitory computer-readable medium) that stores the user's preferences for information format and is in communication with the one or more processors 180. Further, a first sensor of the two or more sensors 184 can be positioned downhole from a second sensor of the two or more sensors 184 in the borehole. Further, the borehole can extend from a surface into a subsurface.

In addition, the one or more processors 180 of the server 178 can operate to perform certain actions. For example, the one or more processors 180 of the server 178 can operate to determine, responsive to the received measurements taken when pumping a drilling fluid into the borehole, a first pressure value at the first sensor and a second pressure value at the second sensor. The one or more processors 180 further can operate to determine one or more indicators of a decrease in pressure in the borehole between the first sensor and the second sensor that is attributable to build-up of drill cuttings between the first sensor and the second sensor (each an equivalent cuttings pressure loss). A first equivalent cuttings pressure loss can determined responsive to: a true vertical depth value of each of the first sensor and the second sensor, a measured depth value of each of the first sensor and the second sensor, the first pressure value, the second pressure value, and a mud weight of the drilling fluid. A second equivalent cuttings pressure loss can determined responsive to: the true vertical depth value of each of the first sensor and the second sensor, the measured depth value of each of the first sensor and the second sensor, the first pressure value, the second pressure value, and the mud weight. Further, a third equivalent cuttings pressure loss can determined responsive to: the true vertical depth value of each of the first sensor and the second sensor, the measured depth value of each of the first sensor and the second sensor, the first pressure value, the second pressure value, the mud weight, and a flow-in rate.

The one or more processors 180 also can operate to determine that drill cuttings limit fluid flow in an interval of the borehole between the first sensor and the second sensor responsive to determining one or more of the first equivalent cuttings pressure loss, the second equivalent cuttings pressure loss, and the third equivalent cuttings pressure loss. Additionally, the one or more processors 180 can operate to generate a drill cuttings alert from the one or more of the first equivalent cuttings pressure loss, the second equivalent cuttings pressure loss, and the third equivalent cuttings pressure loss. The one or more processors 180 also can operate to format the drill cuttings alert according to the information format and transmit the formatted drill cuttings alert to the user computing device 170, where the formatted drill cuttings alert can be displayed using the one or more displays 174. Consequently, the formatted drill cuttings alert can be used to detect and mitigate drill cuttings build-up in the interval.

In some circumstances, the drill cuttings alert can include a graphical representation of one or more of the first equivalent cuttings pressure loss, the second equivalent cuttings pressure loss, and the third equivalent cuttings pressure loss as a function of one or more of time and depth in the borehole. Further, the one or more processors 180 can operate to determine a predicted equivalent cuttings pressure loss for the borehole, and the formatted drill cuttings alert further can include a graphical representation of the predicted equivalent cuttings pressure loss for the borehole.

An exemplary formatted drill cuttings alert 300 as displayed on an interface is illustrated in FIGS. 6-12, for instance. The interface illustrated in FIG. 6, which shows the exemplary formatted drill cuttings alert 300 as a whole, can provide a simple display of multiple parameters for visualizing multiple time and depth values from along string measurements (ASM), for instance. The exemplary formatted drill cuttings alert 300 can include, for example, an equivalent mud weight (EMW) display 310, a depiction of mud weight in and flow rate (or flow-in rate) in 320, a wellbore profile 330, a formation pressure window 340, and a gauge box and trend display 350.

Figure 7A:
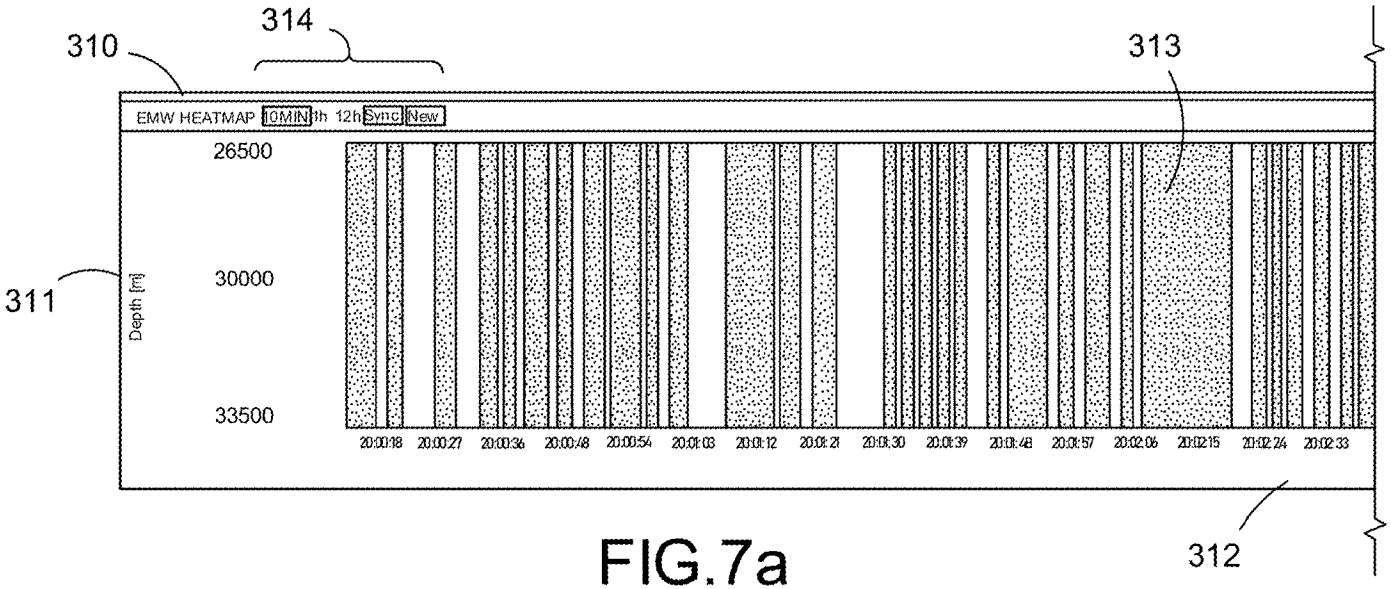
FIGS. 7*a-b* is a schematic diagram of an interface according to an embodiment of the invention.
Figure 7B:
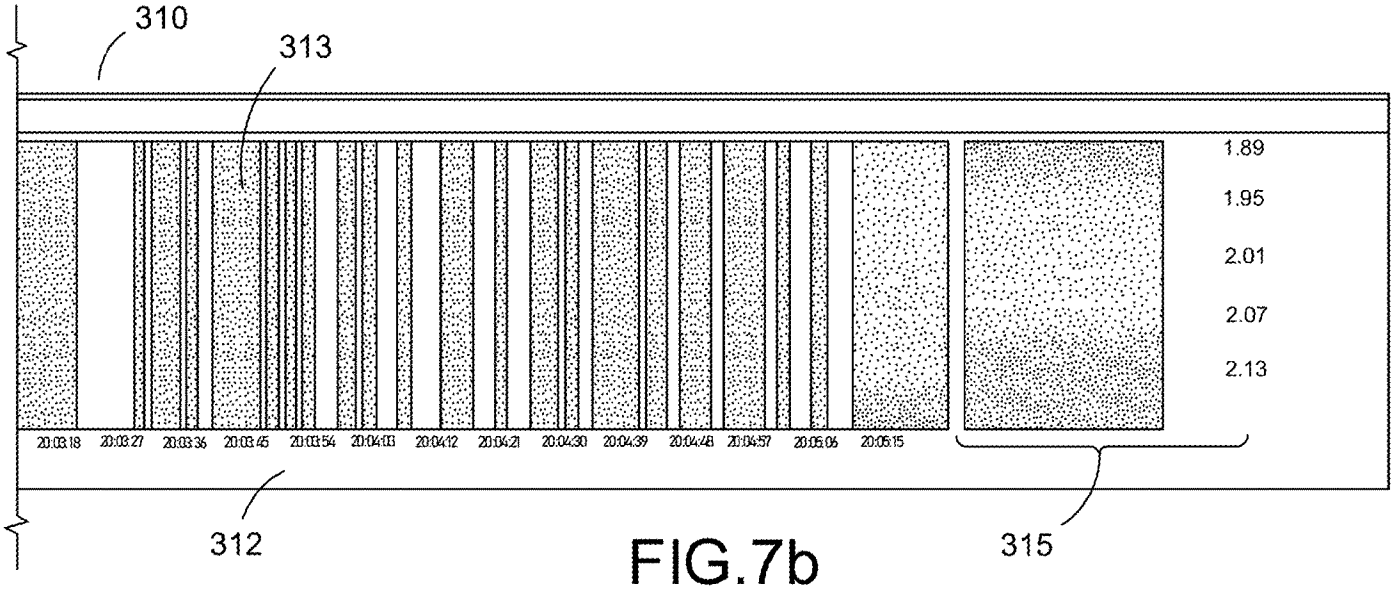

An EMW display 310, as illustrated in FIG. 7*a* and FIG. 7*b*, for example, can depict a comparison of time 312 (along the x-axis) and depth 311 (along the y-axis) of EMW (density), which can allow a user to compare fluid density values (derived from annular pressure sensors) to quickly analyze values plotted at different depths and times. As depicted, for example, depth 311 is shown in meters. In the density plot area 313, density at various depths over time can be represented by different colors in accordance with a legend 315. As illustrated, for example, an interval of the borehole at depths between 25999 m and 33566 m can exhibit relatively low EMW in a displayed time period of approximately five minutes (from 20:00:18 to 20:05:15 UTC) until time 20:05:05, at which point EMW can increase noticeably. An EMW display 310 sometimes can be described as an EMW heatmap, for example. Further, an EMW display 310 can include display options 314 such as "10 min," "1 h," "2 h," "Sync," and "Now."

Figure 8A:
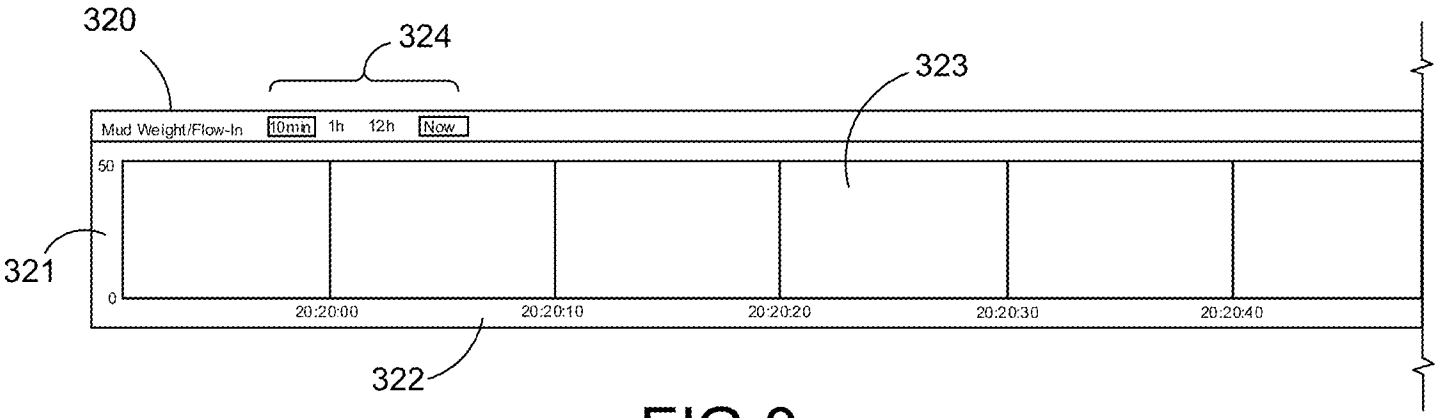
FIG. 8*a-b* is a schematic diagram of an interface according to an embodiment of the invention.
Figure 8B:
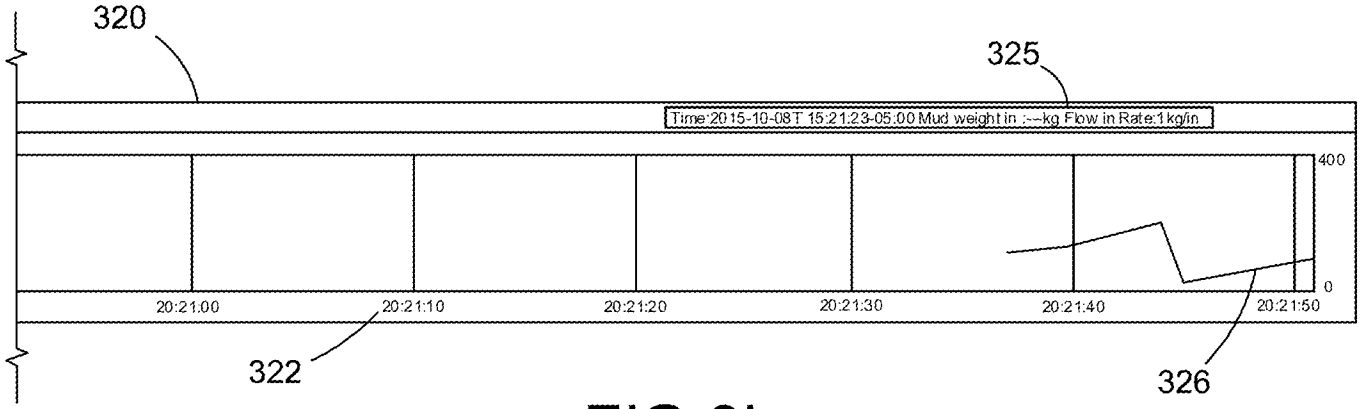

Additionally, a depiction of mud weight in and flow rate in 320, as illustrated in FIG. 8*a* and FIG. 8*b*, for instance, can plot fluid flow-in rate and mud weight at the surface 321 over time 322 (along the x-axis), as will be understood by those skilled in the art, as a plot line 326 in a plot area 323.

Fluid flow-in rate can be calculated from a pump rate. A depiction of mud weight in and flow-in rate 320 can include display options 324 such as "10 min," "1 h," "2 h," "Sync," and "Now." A current value of fluid flow-in rate and mud weight in can be displayed in area 325.

Figure 9:
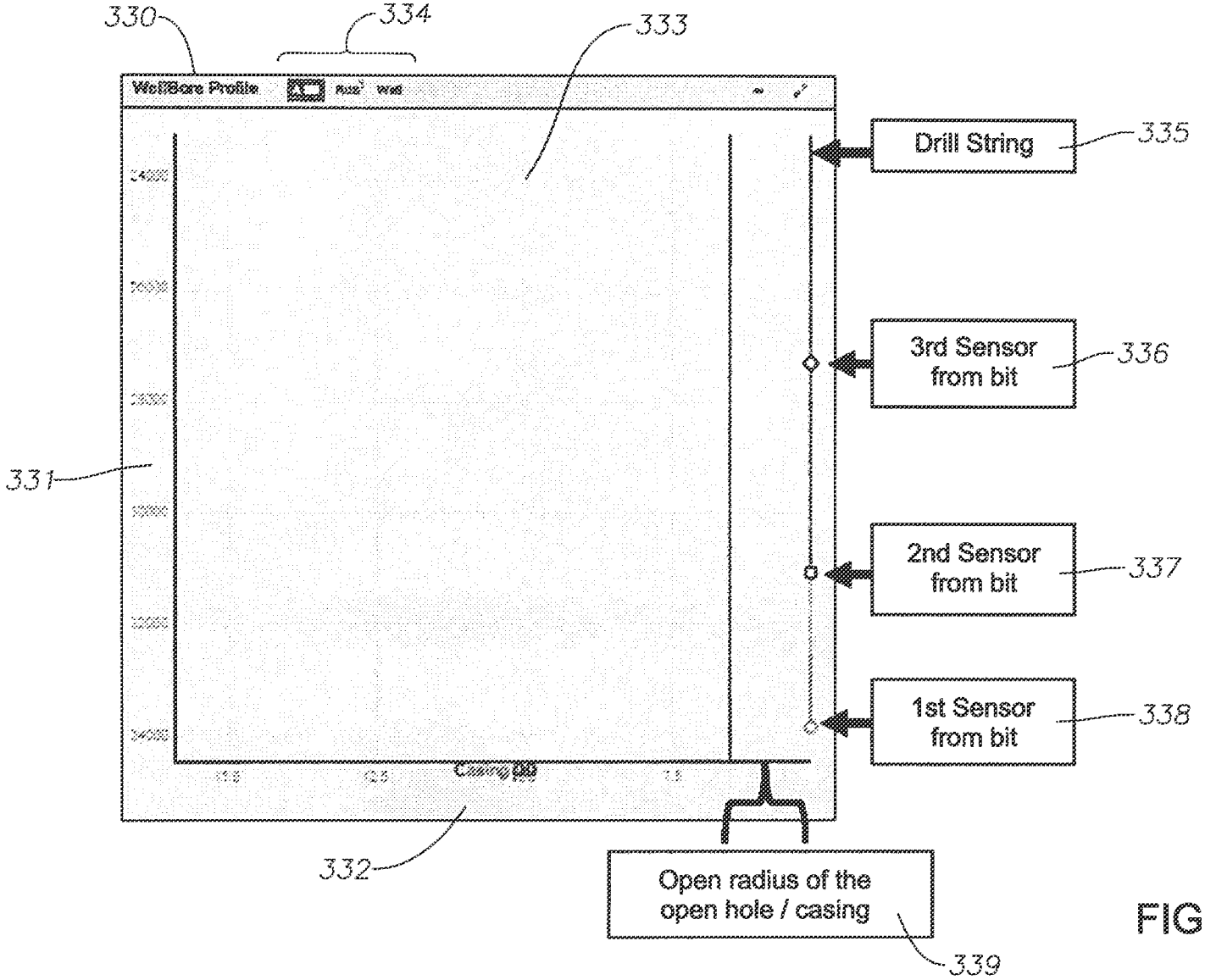
FIG. 9 is a schematic diagram of an interface according to an embodiment of the invention.

An exemplary formatted drill cuttings alert 310 also can include a wellbore profile 330, as illustrated in FIG. 9, for instance. A wellbore profile 330 can provide a display of measured depth (MD) 331 along the y-axis and width 332 along the x-axis in a plot area 333. The diameter 332 either can be the size of the diameter of the open hole (bit size) or the diameter of the casing, as will be understood by those skilled in the art. A wellbore profile 330 can illustrate, for example, the open radius of the open hole/casing 339, as depicted. Further, a wellbore profile 330 can include display options 334 such as tools location zoom, current run, and well, e.g., "ASM," "Run," and "Well." A wellbore profile 330 also can provide a visual to quickly display sensor locations in the wellbore relative to diameter size. For example, the a wellbore profile 330 can illustrate the position of a first sensor from the drill bit 338, a second sensor from the drill bit 337, and a third sensor from the drill bit 336 along the drill string 335 by depth 331. As depicted in FIG. 9, for example, the drill string and sensor locations are plotted to compare different locations in the well. Further, a wellbore profile can visualize diameter changes for fluid flow.

Figure 10:
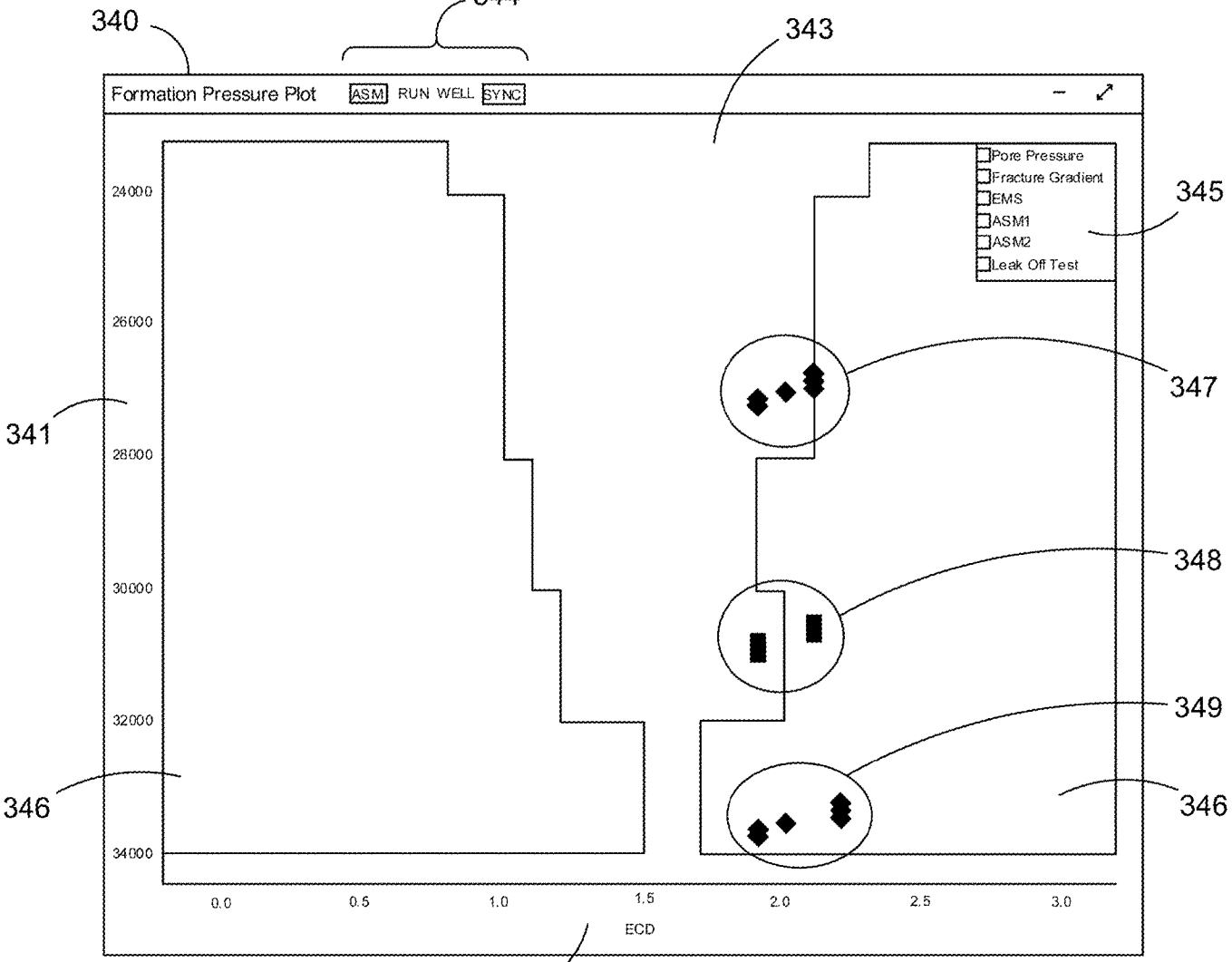
FIG. 10 is a schematic diagram of an interface according to an embodiment of the invention.
Figure 11:
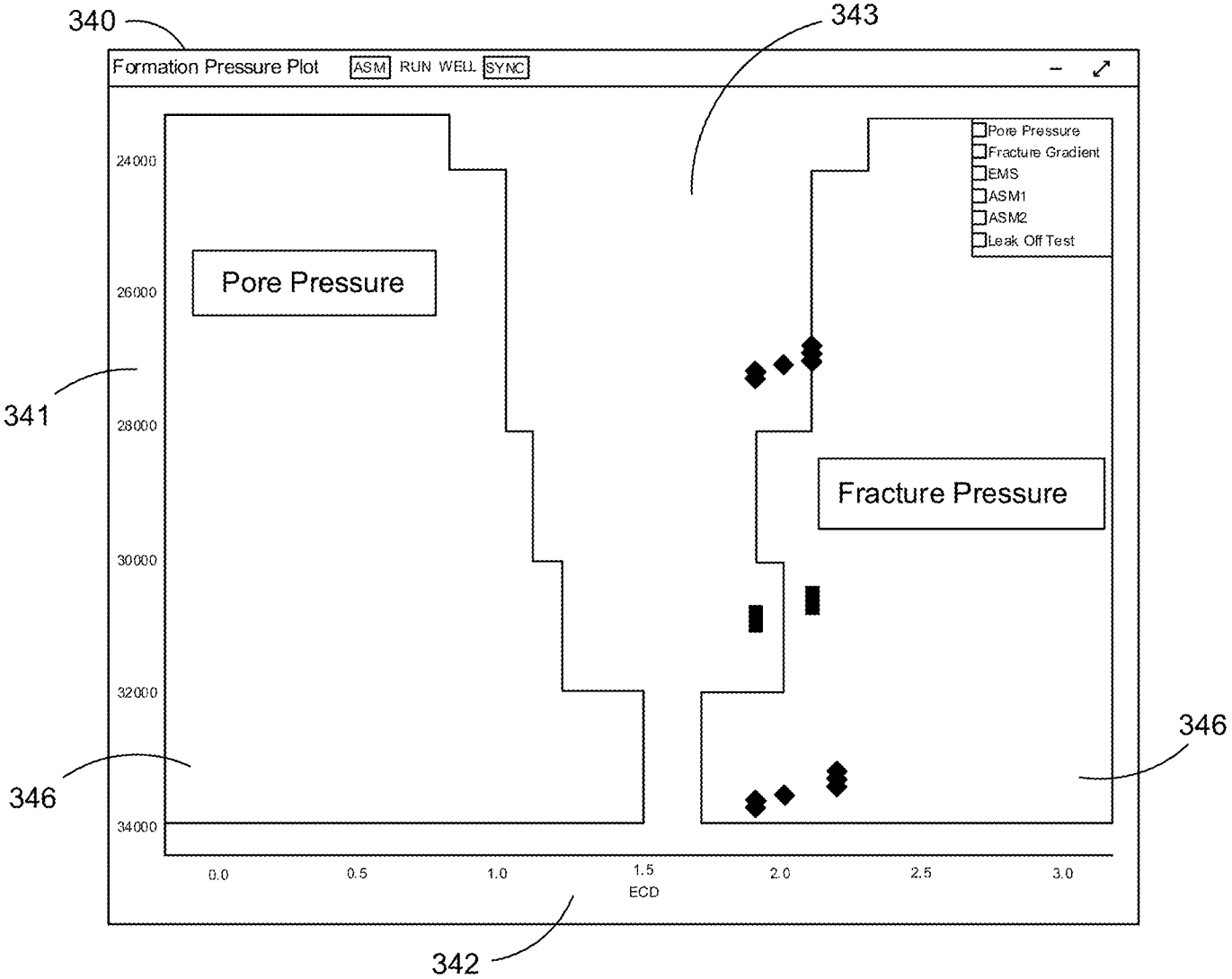
FIG. 11 is a schematic diagram of an interface according to an embodiment of the invention.

Additionally, an exemplary formatted drill cuttings alert 310 can include a formation pressure window 340, such as the formation pressure windows 340 illustrated in FIG. 10 and FIG. 11, for instance. A formation pressure window 340 can compare sensor values 342 to the pore and fracture gradients, relative to depth 341, as illustrated in FIG. 10, for example. Further, a formation pressure window 340 can show historical values as they were generated by MD. Such values either can be a solid dot (ECD) or hollow (ESD), and colors can match the sensor color point in the drill string in some circumstances. An equivalent circulating density (sometimes abbreviated as ECD), as will be understood by those skilled in the art, can be an effective density of the drilling fluid that would cause the pressure in the borehole to have the same value as a pressure measurement taken while pumping drilling fluid into the borehole. An equivalent static density (sometimes abbreviated as ESD), as will be understood by those skilled in the art, can be an effective density of the drilling fluid that would cause the pressure in the borehole to have the same value as a pressure measurement taken while drilling fluid is not being pumped into the borehole. For example, historical values at a first sensor 348, historical values at a second sensor 347, and historical EMS values 349 can be displayed in a plot area 343 with pore pressure 346. A legend 345 can include different colors to represent different measurements and values. The pore and fracture pressures can be provided by the operator, for example. Further, a formation pressure window 340 can include display options 344 such as "ASM," "Run," "Well," and "Sync." As depicted in FIG. 11, for instance, a formation pressure window can depict ECD as a function of depth. The pore pressure area 346 illustrated in the left portion of the plot area 343 can indicate pore pressure, whereas the fracture pressure area 346 illustrated in the right portion of the plot area 343 can indicate fracture pressure. Consequently, an operator can take steps to endeavor to keep pressure measurements in between pore pressure and fracture pressure by use of the formation pressure window 340.

Figure 12:
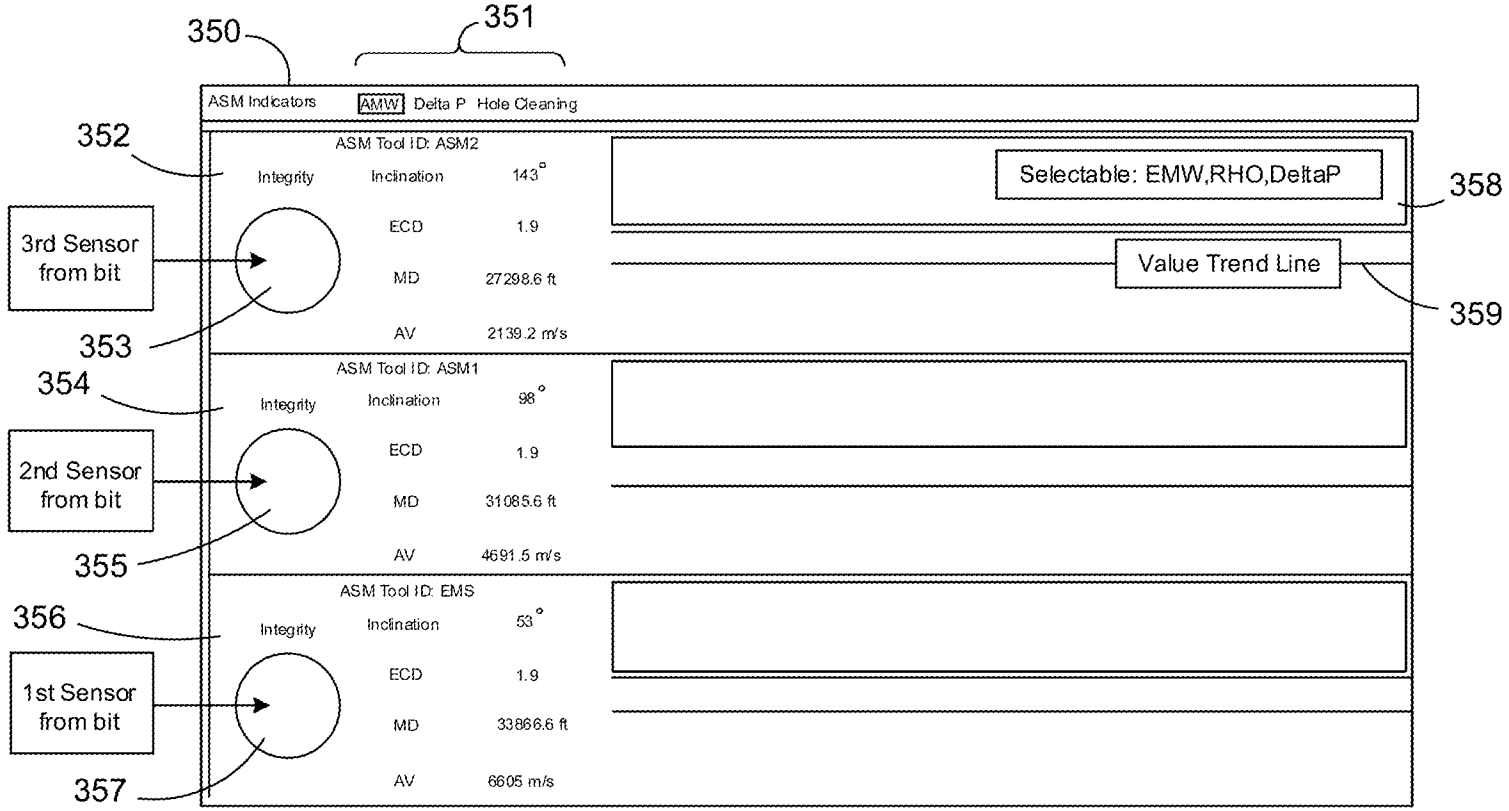
FIG. 12 is a schematic diagram of an interface according to an embodiment of the invention.

An exemplary formatted drill cuttings alert 310 also can include a gauge box and trend display 350, as illustrated in FIG. 12, for example. A gauge box (such as gauge box 356 for the first sensor from the drill bit 338, gauge box 354 for the second sensor from the drill bit 337, or gauge box 352 for the third sensor from the drill bit 336) can display an alarm light (such as alarm light 357, alarm light 355, and alarm light 353, respectively). The color of such an alarm light can be dependent on the value approaching pore or fracture pressure limits. For example, alarm light 357 could be red while alarm light 355 and alarm light 353 are green. As illustrated, the values displayed can include current EMW (ESD or ECD), current MD, annular velocity of the fluid (AV), and inclination of the wellbore for the tool current location. A trend display 358 can allow a user to select EMW (fluid density), RHO (cuttings in suspension), and Delta P (cuttings bedding), for example. Further, a color gradient can provide an intensity plot for a select period. A trend line 359 to monitor fluid density and cuttings transport can provide a way to identify trends over time; darker shades can show a build-up, for example. Vertical lines that bisect a trend line can indicate when pumps turn on and off, and lines indicating that a pump turned on can be displayed in a different color than lines indicating that a pump turned off. Display options 351 also can include "EMW," "Delta P," and "Hole Cleaning."

In an exemplary method according to an embodiment, two downhole pressure sensors are used to measure annular pressure. These sensors are represented in this description by $ASM_{(i)}$ and $ASM_{(i+1)}$, where i is a numeral and $ASM_{(i)}$ is downhole from $ASM_{(i+1)}$. A first sensor ($ASM_{(i)}$) is located within the borehole at a certain true vertical depth ($TVD_{(i)}$) and a certain measured depth ($MD_{(i)}$). Likewise, a second sensor ($ASM_{(i+1)}$) is located at $TVD_{(i+1)}$ and $MD_{(i+1)}$. Because $ASM_{(i)}$ is downhole from $ASM_{(i+1)}$ in this example, $MD_{(i)}$ is greater than $MD_{(i+1)}$. $TVD_{(i)}$ can be greater than $TVD_{(i+1)}$ but need not be, particularly in the case of a horizontal well or horizontal interval of a wellbore, for example. Annular pressure (AP) while drilling fluid is flowing is measured at each sensor $ASM_{(i)}$ and $ASM_{(i+1)}$ and is represented in this description as $AP_{(i)f}$ and $AP_{(i+1)f}$, respectively. Annular pressure also can be measured at each sensor while drilling fluid is static (that is, not flowing), or it can be estimated at each sensor. Static pressure at $ASM_{(i)}$ and $ASM_{(i+1)}$ is represented in this description as $AP_{(i)s}$ and $AP_{(i+1)s}$, respectively. $AP_{(i+1)s}$ can be estimated as: $AP_{(i+1)s}=MW\Phi\times g\times TVD_{(i+1)}$. $AP_{(i)s}$ can be estimated as: $AP_{(i)s}=MW\Phi\times g\times TVD_{(i)}$. Alternatively, $AP_{(i)s}$ can be estimated as: $AP_{(i)s}=AP_{(i+1)s}+MW\Phi\times g\times(TVD_{(i)}-TVD_{(i+1)})$. Given mud weight MWΦ and flow-in rate (Flow-In), indicators as described herein can be calculated:

$$PCUT_{(i)}=(AP_{(i)f}+(MW\Phi\times g\times TVD_{(i+1)})-AP_{(i+1)f}-(MW\Phi\times g\times TVD_{(i)})/(MD_{(i)}-MD_{(i+1)})$$

$$YCUT_{(i)}=(AP_{(i)f}+AP_{(i+1)s}-AP_{(i)f}-(MW\Phi\times g\times TVD_{(i)})/(MD_{(i)}-MD_{(i+1)})$$

$$FRICN_{(i)}=(AP_{(i)f}+AP_{(i+1)s}-AP_{(i+1)f}-AP_{(i)s})/(MD_{(i)}-MD_{(i+1)})\times \text{Flow-In}$$

$$RHO_{(i)}=(AP_{(i)s}-AP_{(i+1)s})/(g\times(TVD_{(i)}-TVD_{(i+1)}))-MW\Phi$$

$$LOAD_{(i)}=(AP_{(i)s}-AP_{(i+1)s})-(MW\Phi\times g\times(TVD_{(i)}-TVD_{(i+1)})))/(MD_{(i)}-MD_{(i+1)})$$

$$FRIC_{(i)}=(AP_{(i)f}+AP_{(i+1)s}-AP_{(i+1)f}-AP_{(i)s})/(MD_{(i)}-MD_{(i+1)})$$

where g represents acceleration due to gravity, a subscript "s" indicates a value when flow is static, and a subscript "f" indicates a value when flowing (that is, when circulating).

These indicators of cuttings bed build-up and poor hole cleaning between sensors can be used to initiate automatic hole cleaning procedures. Distributed downhole pressure data can be collected, and this information can be displayed in real-time.

Although mud weight can be measured, it also can be estimated using internal pressure measurements taken at two sensors, represented in this description by $ASM_{(n-1)}$ and $ASM_{(n)}$, where n is a numeral and $ASM_{(n-1)}$ is downhole from $ASM_{(n)}$. A first sensor ($ASM_{(n-1)}$) is located within the borehole at a certain true vertical depth ($TVD_{(n-1)}$). Likewise, a second sensor ($ASM_{(n)}$) is located at $TVD_{(n)}$. Because $ASM_{(n-1)}$ is downhole from $ASM_{(n)}$ in this example, $TVD_{(n-1)}$ can be greater than $TVD_{(n)}$ but need not be, particularly in the case of a horizontal well or horizontal interval of a wellbore, for example. Internal static pressure at $ASM_{(n-1)}$ and $ASM_{(n)}$ is represented in this description as $IP_{(n-1)s}$ and $IP_{(n)s}$, respectively. Mud weight (MWΦ) can be estimated as: $MW\Phi=(IP_{(n)s}/g\times TVD_{(n)})$ or $MW\Phi=(IP_{(n-1)s}-IP_{(n)s})/g\times(TVD_{(n-1)}-TVD_{(n)})$).

Figure 3A:
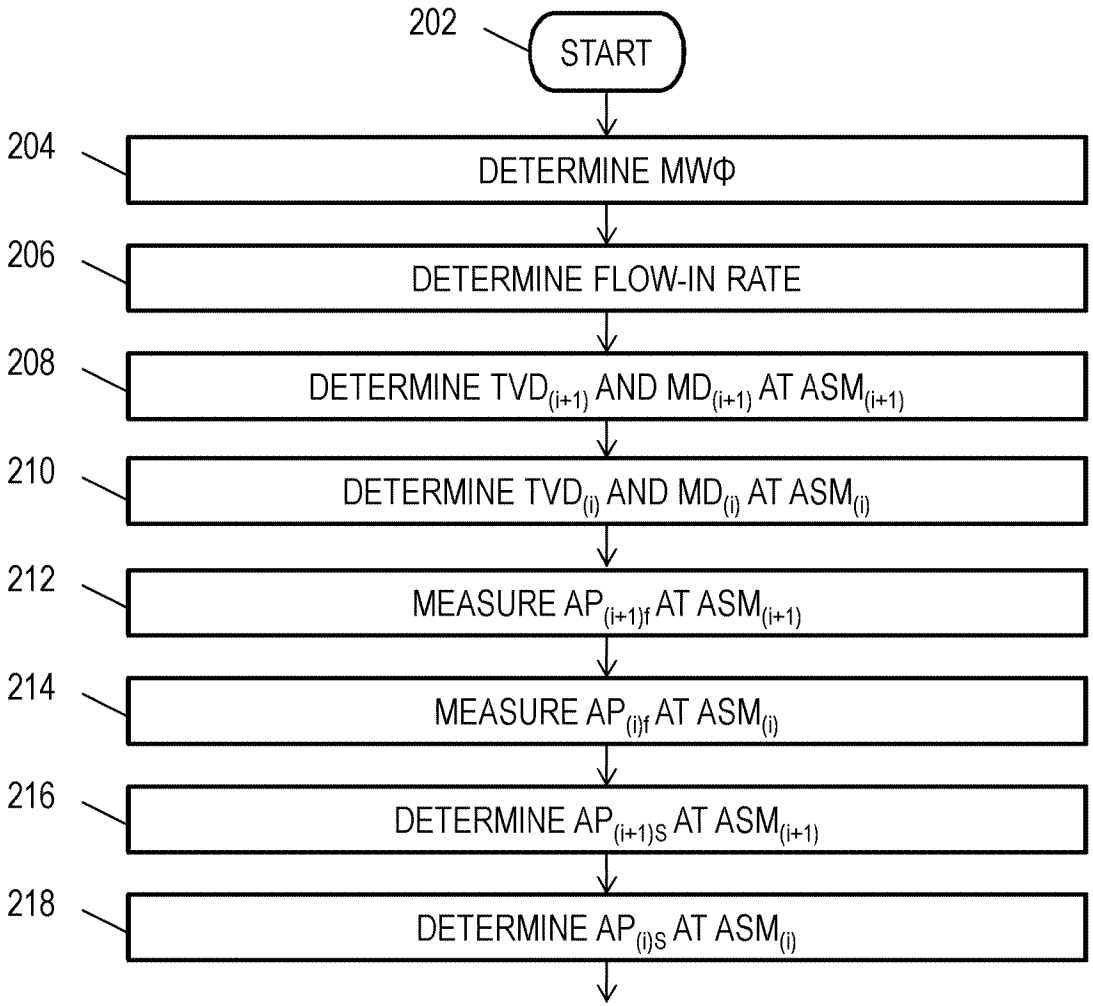
FIGS. 3*a-b* is a schematic diagram of a method according to an embodiment of the invention.
Figure 3B:
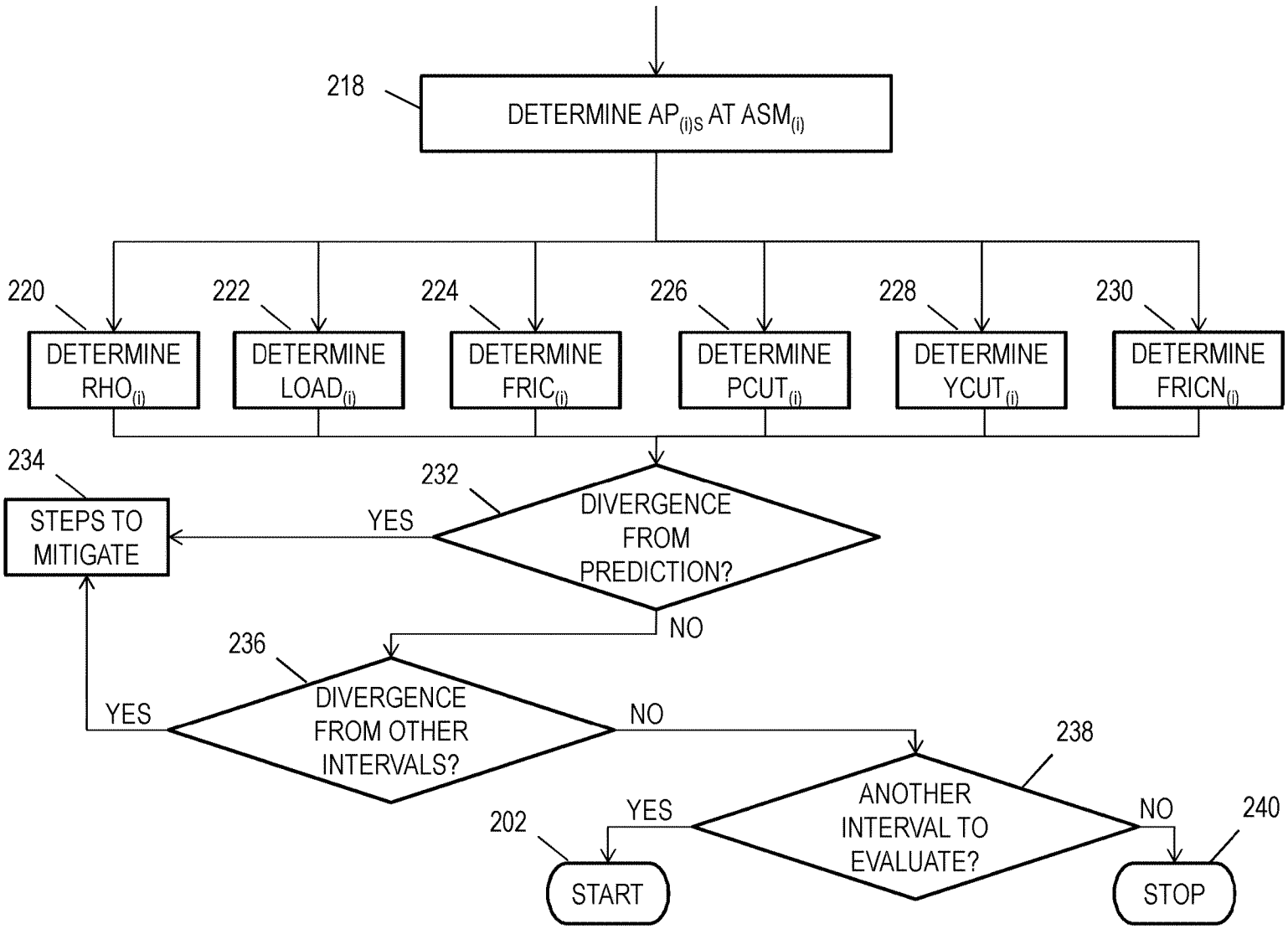
Figure 4A:
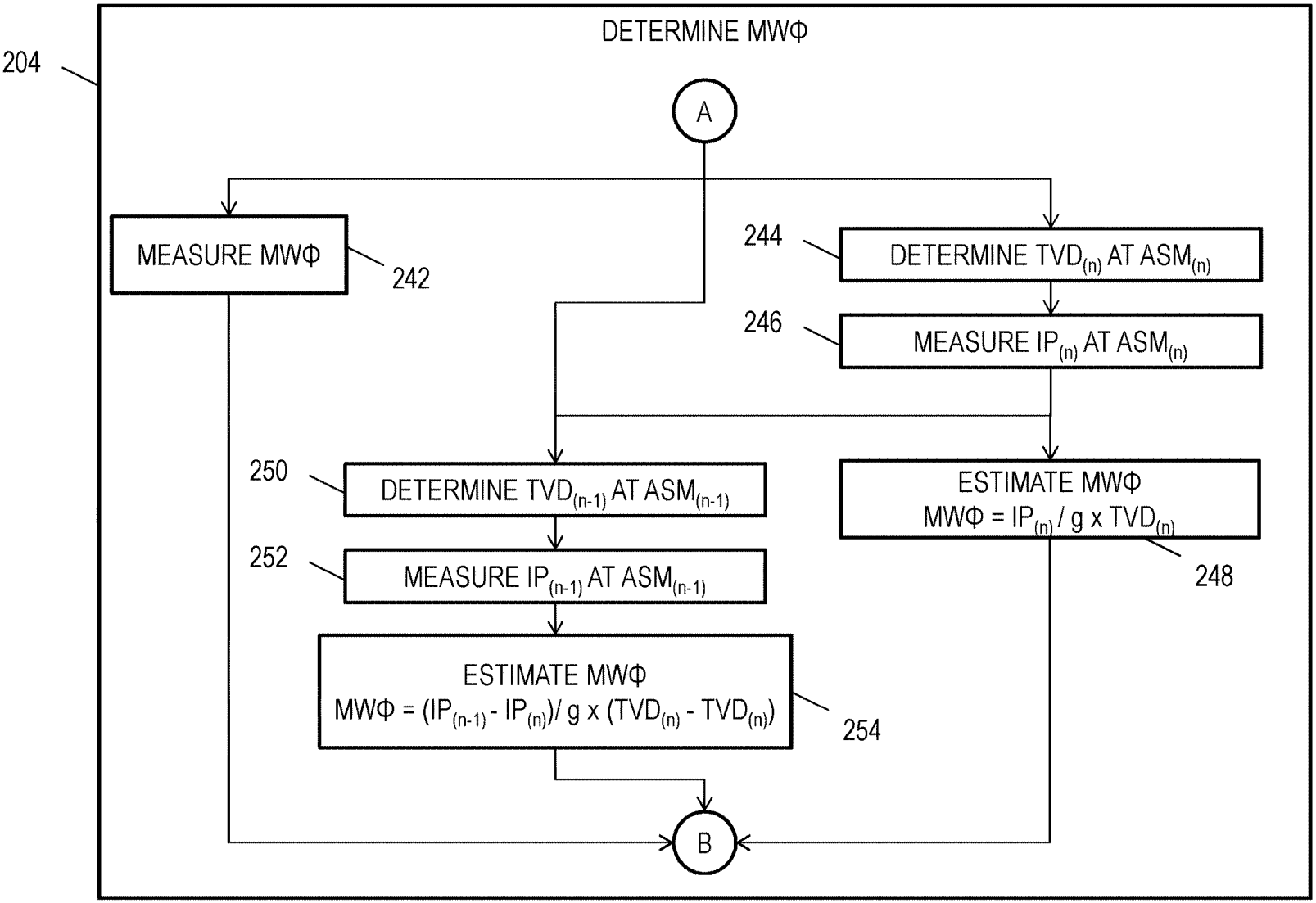
FIGS. 4*a-c* are schematic diagrams of a method according to an embodiment of the invention.

An exemplary method according to an embodiment is illustrated in FIG. 3*a-b* and FIG. 4*a-c*, for instance. It should be understood that there can be additional, fewer, or alternative steps performed in similar or alternative orders, or in parallel, within the scope of the various embodiments unless otherwise stated. After starting 202, as illustrated in FIG. 3*a* for example, the illustrated method can include determining the mud weight (MWΦ) at step 204 and determining flow-in rate at step 206. Mud weight can be determined 204 as illustrated in FIG. 4*a*, for example. That is, mud weight can be measured at step 242. Mud weight also can be estimated. For instance, mud weight can be estimated at step 248 after determining true vertical depth at the (n)th sensor ($TVD_{(n)}$ at $ASM_{(n)}$) at step 244 and measuring the internal pressure while the drilling fluid is not flowing (that is, static) at the (n)th sensor ($IP_{(n)s}$ at $ASM_{(n)}$) at step 246. Additionally, mud weight can be estimated at step 254 by also determining true vertical depth at the (n−1)th sensor ($TVD_{(n-1)}$ at $ASM_{(n-1)}$) at step 250 and measuring the internal pressure while the drilling fluid is not flowing at the (n−1)th sensor ($IP_{(n-1)s}$ at $ASM_{(n-1)}$) at step 252.

In addition to determining mud weight at step 204 and flow-in rate at step 206, as illustrated in FIG. 3*a*, a method further can include determining true vertical depth and measured depth at the (i+1)th sensor (such as the second sensor when i=1)—that is, $TVD_{(i+1)}$ and $MD_{(i+1)}$ at $ASM_{(i+1)}$, respectively—at step 208. Additionally, a method can include determining true vertical depth and measured depth at the (i)th sensor (such as the first sensor when i=1)—that is, $TVD_{(i)}$ and $MD_{(i)}$ at $ASM_{(i)}$, respectively—at step 210. A method then can include measuring the annular pressure while the drilling fluid is flowing at the (i+1)th sensor ($AP_{(i+1)f}$ at $ASM_{(i+1)}$) at step 212 and measuring the annular pressure while the drilling fluid is flowing at the (i)th sensor ($AP_{(i)f}$ at $ASM_{(i)}$) at step 214.

Figure 4B:
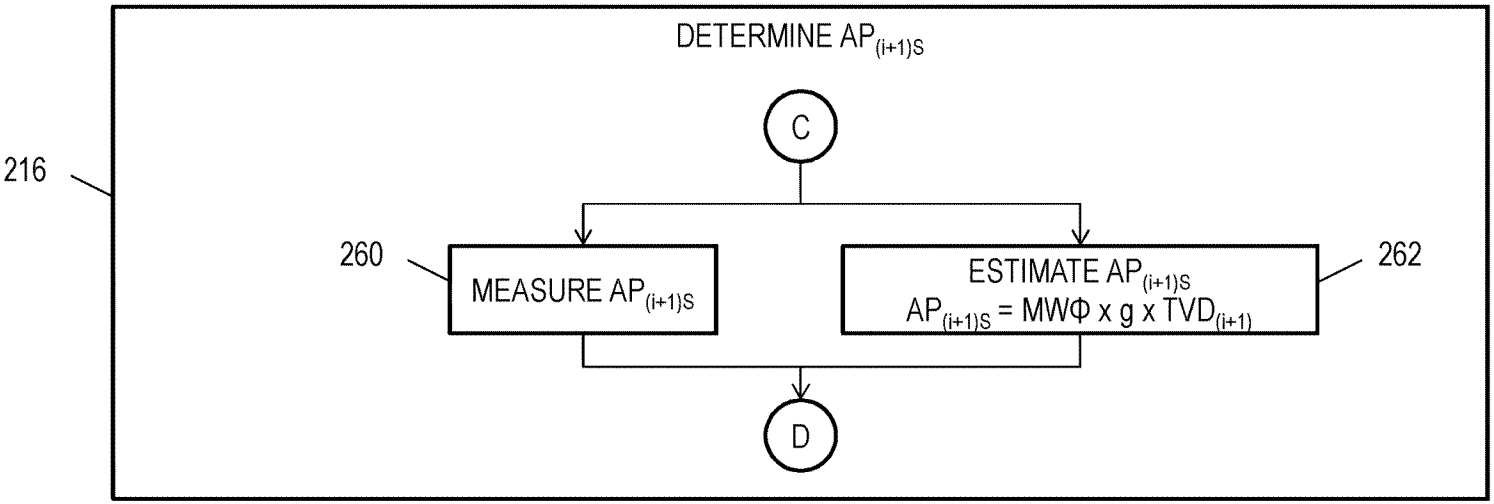
Figure 4C:
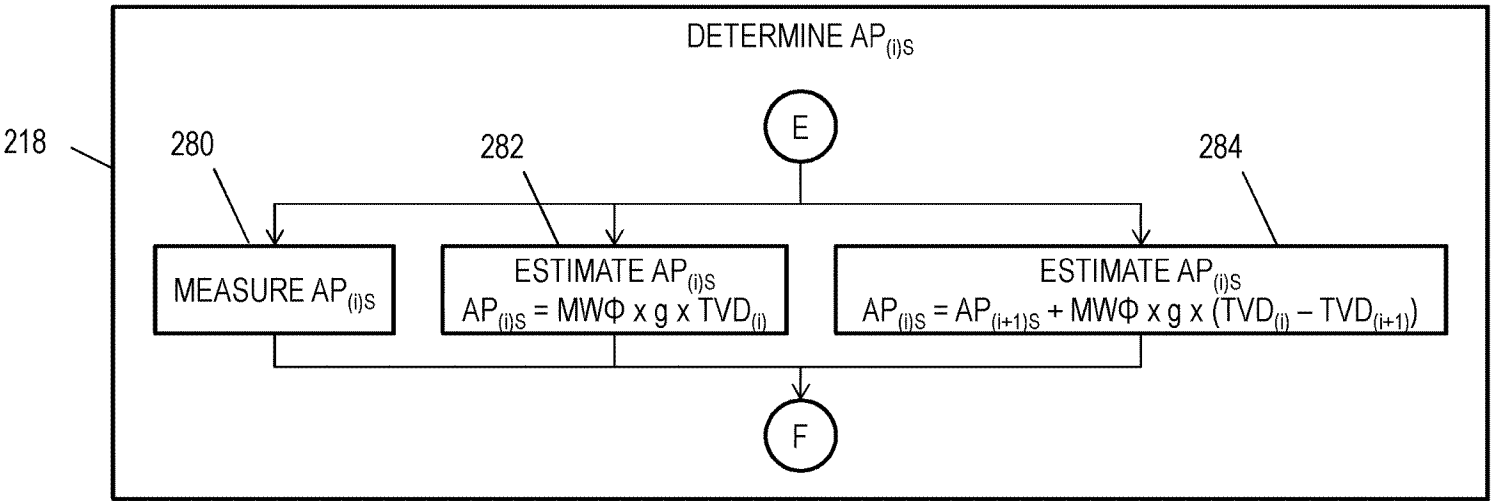

A method then can include determining the annular pressure while the drilling fluid is not flowing at the (i+1)th sensor ($AP_{(i+1)s}$ at $ASM_{(i+1)}$) at step 216 and determining the annular pressure while the drilling fluid is not flowing at the (i)th sensor ($AP_{(i)s}$ at $ASM_{(i)}$) at step 218. As illustrated in FIG. 4*b*, determining the annular pressure while the drilling fluid is not flowing at the (i+1)th sensor ($AP_{(i+1)s}$ at $ASM_{(i+1)}$) at step 216 can include measuring the annular pressure at step 260 or estimating the annular pressure at step 262. Likewise, as illustrated in FIG. 4*c*, determining the annular pressure while the drilling fluid is not flowing at the (i)th sensor ($AP_{(i)s}$ at $ASM_{(i)}$) at step 218 can include measuring the annular pressure at step 280 or estimating the annular pressure at step 282 or step 284.

A method then can include determining one or more indicators of pressure loss in the interval of the borehole between the (i)th sensor and the (i+1)th sensor and/or portions of effective density of the drilling fluid that are attributable to build-up of drill cuttings in the interval of the borehole between the (i)th sensor and the (i+1)th sensor, as illustrated in FIG. 3*b*. For example, a method can include determining $RHO_{(i)}$ at step 220, determining $LOAD_{(i)}$ at step 222, determining $FRIC_{(i)}$ at step 224, determining $PCUT_{(i)}$ at step 226, determining $YCUT_{(i)}$ at step 228, and/or determining $FRICN_{(i)}$ at step 230. The determined indicators then can be compared to prior predictions to determine whether they diverge from the predictions at step 232. If there is a divergence at step 232, steps to mitigate the drillings build-up or loss in pressure can be taken at step 234. If there is not a divergence at step 232, the calculated values can be compared to indicators for other sections of the borehole at step 236. If there is a divergence at step 236, steps to mitigate the drillings build-up or loss in pressure in the section between the first sensor and the second sensor can be taken 234. If there is not a divergence at step 236, a method can include determining whether there are other sections of the borehole to be evaluated at step 238. If there are other sections to evaluate at step 238, the process can start again 202. If there are no other sections to evaluate at step 238, the process can end 240.

Figure 13:
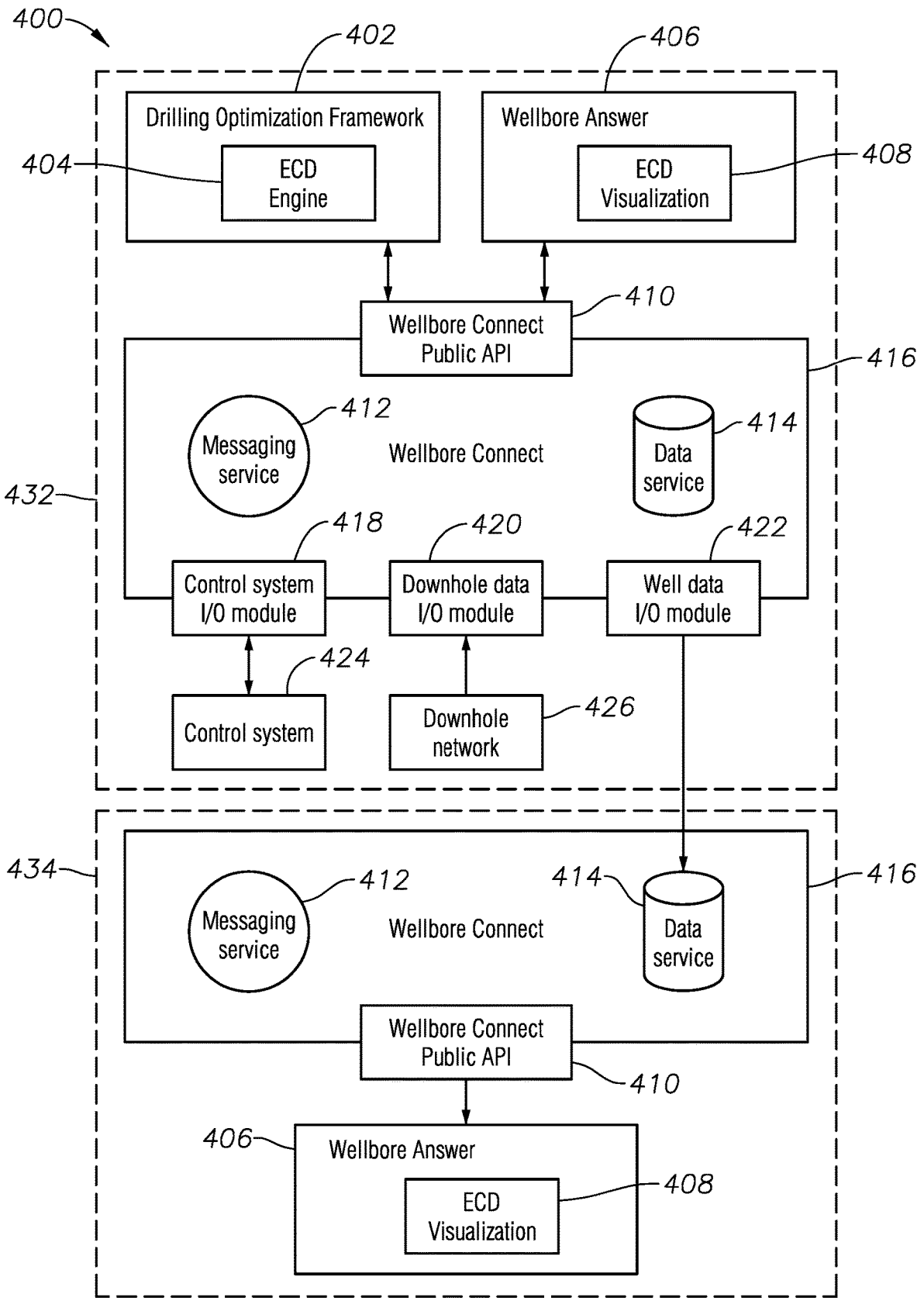
FIG. 13 is a schematic diagram of a data flow diagram according to an embodiment of the invention.

Embodiments of the invention still further can include non-transitory computer-readable media with computer-executable instructions stored thereon executed by one or more processors to perform a method, including methods such as those described in this specification. Embodiments can include and incorporate computer programs configured to perform methods and steps to detect and mitigate drill cuttings build-up in borehole drilling for hydrocarbon wells. For instance, an exemplary computer program architecture diagram 400 is illustrated in FIG. 13. In the example illustrated, some interactions of components of the exemplary computer program architecture diagram 400 are illustrated as occurring at or related to the well site 432, whereas other interactions are illustrated as occurring at or related to a data center 434. A computer program that can perform or direct performance of some of the methods and operations described herein is referred to in this example as a wellbore connect computer program 416, for example. Such a wellbore connect computer program 416 can be associated with a public application programming interface (API) 410, as will be understood by those skilled in the art. The wellbore connect computer program 416 can include a messaging service 412 and a data service 414. The wellbore connect computer program 416 also can include one or more input/output modules. A module, as used in this description of the exemplary computer program architecture diagram 400 illustrated in FIG. 13, can include a portion of a computer program that relates to and operates to effect certain functions of the computer program, for example, as will be understood by those skilled in the art. An input/output (I/O) module can relate to a one-way or two-way communications of data between the wellbore connect computer program 416 and another system or network, for example. As illustrated, the wellbore connect computer program 416 can include a control system I/O module 418 to provide two-way communication between the wellbore connect computer program 416 and a control system 424. The control system 424 can control operation of a drill string assembly or other drilling equipment or operations. Consequently, two-way communication between the control system 424 and the wellbore connect computer program 416 can include control commands sent from the wellbore connect computer program 416 to the control system 424, as well as feedback sent from the control system 424 to the wellbore connect computer program 416. A downhole data I/O module 420 can provide data from a downhole network 426 (such as a network of annular pressure sensors, for example) to the wellbore connect computer program 416. Data provided from the downhole network 426 to the wellbore connect computer program 416 can include, for example, pressure measurements from downhole sensors. Further, a well data I/O module 422 can provide data from the wellbore connect computer program 416 at the well site 432 to a data service 414 of the wellbore connect computer program 416 at the data center 434.

As illustrated, the well site 432 and data center 434 are remote from each other but are in communication, such as via satellite link between well data I/O module 422 at the well site 432 and data service 414 at the data center 434. It is to be understood, however, that the well site 432 and data center 434 need not be remote from each other and instead can be in the same location. Additionally, the interactions illustrated as occurring at or related to the well site 432 in FIG. 13 can occur at a location remote from the well site 432 even when the downhole network 426 is located at the well site 432. In some circumstances, the interactions illustrated as occurring at or related to the well site 432 can be performed by a server 178 and the interactions illustrated as occurring at or related to the data center 434 can be performed by a user computing device 170, as illustrated in FIG. 15, for example.

By use of the public API 410, the wellbore connect computer program 416 can provide a drilling optimization framework 402 at the well site 432. Such a drilling optimization framework 402 can include an equivalent circulating density (ECD) engine 404 and can relate to some of the methods described herein. Further, the wellbore connect computer program 416 can provide a wellbore answer interface 406 by use of the public API 410 that can provide ECD visualization 408 at both the well site 432 and at the data center 434. For example, a wellbore answer interface 406 can relate to or cause to generate one or more of the interfaces illustrated in FIGS. 6-12.

In the various embodiments of the invention described herein, a person having ordinary skill in the art will recognize that various types of memory are readable by a computer, such as the memory described herein in reference to the various computers and servers, e.g., computer, computer server, web server, or other computers with embodiments of the present invention. Examples of computer-readable media can include but are not limited to: nonvolatile, hard-coded type media, such as read only memories (ROMs), CD-ROMs, and DVD-ROMs, or erasable, electrically programmable read only memories (EEPROMs); recordable type media, such as floppy disks, hard disk drives, CD-R/RWs, DVD-RAMs, DVD-R/RWs, DVD+R/RWs, flash drives, memory sticks, and other newer types of memories; and transmission type media such as digital and analog communication links. For example, such media can include operating instructions, as well as instructions related to the systems and the method steps described above and can operate on a computer. It will be understood by those skilled in the art that such media can be at other locations instead of, or in addition to, the locations described to store computer program products, e.g., including computer programs or software thereon. It will be understood by those skilled in the art that the various computer program modules or electronic components described above can be implemented and maintained by electronic hardware, software, or a combination of the two and that such embodiments are contemplated by embodiments of the present invention.

In the drawings and specification, there have been disclosed embodiments of systems, methods, computer-readable media having computer programs, and electronic interfaces of the present invention, and although specific terms are employed, the terms are used in a descriptive sense only and not for purposes of limitation. The embodiments of systems, methods, computer-readable media having computer programs, and electronic interfaces of the present invention have been described in considerable detail with specific reference to these illustrated embodiments. It will be apparent, however, that various modifications and changes can be made within the spirit and scope of the embodiments of systems, methods, computer-readable media having computer programs, and electronic interfaces of the present invention as described in the foregoing specification, and such modifications and changes are to be considered equivalents and part of this disclosure.

The invention claimed is:

1. A system to detect and mitigate drill cuttings build-up m borehole drilling for hydrocarbon wells, the system comprising:

a borehole positioned in a subsurface;

a drill string assembly including a drill bit, a drill string connected to the drill bit, and a motor connected to the drill string, the drill bit and the drill string being positioned within the borehole, the drill string also being positioned to transmit drilling fluid and torque from the motor to the drill bit when positioned within the borehole;

a controller including one or more processors positioned at a surface of the borehole to control operations of the drill string assembly;

a first annular pressure sensor in communication with the controller and positioned along outer surfaces of the drill string in the borehole;

a second annular pressure sensor in communication with the controller and positioned along outer surfaces of the drill string in the borehole, the first annular pressure sensor being positioned downhole from the second annular pressure sensor in the borehole;

an electronic display in communication with the controller to display well data thereon; and non-transitory computer-readable medium in communication with the one or more processors of the controller and having one or more computer programs stored therein that, when executed by the one or more processors, cause the system to:

determine, for each of the first annular pressure sensor and the second annular pressure sensor, an orthogonal distance from the surface to the respective pressure sensor thereby defining a vertical depth value therebetween, determine, for each of the first annular pressure sensor and the second annular pressure sensor, a distance from the surface to the respective pressure sensor along the path of the drill string thereby defining a measured depth value therebetween, determine a rate at which the drilling fluid is pumped into the borehole through the drill string thereby defining a flow-in rate, determine a density of the drilling fluid at the surface thereby defining a mud weight, measure, by the first annular pressure sensor and when pumping the drilling fluid into the borehole, a first flowing pressure value, measure, by the second annular pressure sensor and when pumping the drilling fluid into the borehole, a second flowing pressure value, determine a first static pressure value associated with a measurement of pressure at the first annular pressure sensor when pumping of the drilling fluid into the borehole is substantially halted, determine a second static pressure value associated with a measurement of pressure at the second annular pressure sensor when pumping of the drilling fluid into the borehole is substantially halted, determine a first decrease in pressure in the borehole between the first annular pressure sensor and the second annular pressure sensor that is attributable to build-up of drill cuttings between the first annular pressure sensor and the second annular pressure sensor thereby defining a first equivalent cuttings pressure loss responsive to: the vertical depth value of each of the first annular pressure sensor and the second annular pressure sensor, the measured depth value of each of the first annular pressure sensor and the second annular pressure sensor, the first flowing pressure value, the second flowing pressure value, and the mud weight, determine a second decrease in pressure in the borehole between the first annular pressure sensor and the second annular pressure sensor that is attributable to build-up of drill cuttings between the first annular pressure sensor and the second annular pressure sensor thereby defining a second equivalent cuttings pressure loss responsive to: the vertical depth value of the first annular pressure sensor, the measured depth value of each of the first annular pressure sensor and the second annular pressure sensor, the first flowing pressure value, the second flowing pressure value, the second static pressure value, and the mud weight, determine a third decrease in pressure in the borehole between the first annular pressure sensor and the second annular pressure sensor that is attributable to build-up of drill cuttings between the first annular pressure sensor and the second annular pressure sensor thereby defining a third equivalent cuttings pressure loss responsive to: the measured depth value of each of the first annular pressure sensor and the second annular pressure sensor, the first flowing pressure value, the second flowing pressure value, the first static pressure value, the second static pressure value, and the flow-in rate, generate, by the electronic display, a graphical representation of one or more of the first equivalent cuttings pressure loss, the second equivalent cuttings pressure loss, and the third equivalent cuttings pressure loss, and determine that drill cuttings limit fluid flow in an interval of the borehole between the first annular pressure sensor and the second annular pressure sensor responsive to generating the graphical representation and thereby detect and mitigate drill cuttings build-up in the interval.

2. A system of claim 1, wherein the one or more computer programs, when executed by the one or more processors of the controller, further cause the system to:

determine a first portion of effective density of the drilling fluid in the borehole between the first annular pressure sensor and the second annular pressure sensor that is attributable to build-up of drill cuttings between the first annular pressure sensor and the second annular pressure sensor thereby defining a first average equivalent density contribution of cuttings load between the first annular pressure sensor and the second annular pressure sensor responsive to: the first static pressure value, the second static pressure value, the vertical depth value of each of the first annular pressure sensor and the second annular pressure sensor, and the mud weight;

determine a second portion of effective density of the drilling fluid in the borehole between the first annular pressure sensor and the second annular pressure sensor that is attributable to build-up of drill cuttings between the first annular pressure sensor and the second annular pressure sensor thereby defining a second average equivalent density contribution of cuttings load between the first annular pressure sensor and the second annular pressure sensor responsive to: the vertical depth value of each of the first annular pressure sensor and the second annular pressure sensor, the measured depth value of each of the first annular pressure sensor and the second annular pressure sensor, the first static pressure value, the second static pressure value, and the mud weight;

determine a fourth decrease in pressure in the borehole between the first annular pressure sensor and the second annular pressure sensor that is attributable to build-up of drill cuttings between the first annular pressure sensor and the second annular pressure sensor thereby defining a fourth equivalent cuttings pressure loss responsive to: the measured depth value of each of the first annular pressure sensor and the second annular pressure sensor, the first flowing pressure value, the second flowing pressure value, the first static pressure value, and the second static pressure value;

generate, by the electronic display, a graphical representation of one or more of the first average equivalent density contribution of cuttings load, the second average equivalent density contribution of cuttings load, and the fourth equivalent cuttings pressure loss.

3. A system of claim 2, wherein the one or more computer programs, when executed by the one or more processors of the controller, further cause the system to:

determine a predicted average equivalent density contribution of cuttings load for the borehole and a predicted equivalent cuttings pressure loss for the borehole; and determine that drill cuttings limit fluid flow in the interval of the borehole between the first annular pressure sensor and the second annular pressure sensor responsive to (i) a comparison of the predicted average equivalent density contribution of cuttings load for the borehole to one or more of the first average equivalent density contribution of cuttings load and the second average equivalent density contribution of cuttings load and (ii) a comparison of the predicted equivalent cuttings pressure loss for the borehole to one or more of the first equivalent cuttings pressure loss, the second equivalent cuttings pressure loss, the third equivalent cuttings pressure loss, and the fourth equivalent cuttings pressure loss.

4. A system of claim 3, wherein the one or more computer programs, when executed by the one or more processors of the controller, further cause the system to:

generate, by the electronic display, a graphical representation of the predicted average equivalent density contribution of cuttings load for the borehole and the predicted equivalent cuttings pressure loss for the borehole with the graphical representation of one or more of the first equivalent cuttings pressure loss, the second equivalent cuttings pressure loss, and the third equivalent cuttings pressure loss and the graphical representation of one or more of the first average equivalent density contribution of cuttings load, the second average equivalent density contribution of cuttings load, and the fourth equivalent cuttings pressure loss.

5. A system of claim 1, wherein determining the second static pressure value is responsive to the vertical depth value of the second annular pressure sensor and the mud weight, and wherein determining the first static pressure value is responsive to one of: (i) the second static pressure value, the vertical depth value of each of the first annular pressure sensor and the second annular pressure sensor, and the mud weight, or (ii) the vertical depth value of the first annular pressure sensor and the mud weight.

6. A system of claim 1, wherein the system further comprises:

a first internal pressure sensor in communication with the controller and positioned along inner surfaces of the drill string in the borehole, and a second internal pressure sensor in communication with the controller and positioned along inner surfaces of the drill string in the borehole, the first internal pressure sensor being positioned downhole from the second internal pressure sensor in the drill string; and wherein the one or more computer programs, when executed by the one or more processors of the controller, further cause the system to:

determine, for each of the first internal pressure sensor and the second internal pressure sensor, an orthogonal distance from the surface to the respective pressure sensor thereby defining a vertical depth value therebetween, measure, by the first internal pressure sensor and when pumping of the drilling fluid into the borehole is substantially halted, a first internal pressure value, measure, by the second internal pressure sensor and when pumping of the drilling fluid into the borehole is substantially halted, a second internal pressure value, and determine the mud weight responsive to one of: (i) the second internal pressure value and the vertical depth value of the second internal pressure sensor, or (ii) the vertical depth value of each of the first internal pressure sensor and the second internal pressure sensor, the first internal pressure value, and the second internal pressure value.

7. A system of claim 1, wherein the system further comprises a digital scale to weigh drilling fluid in communication with the controller and positioned at the surface, and wherein determining the mud weight includes measuring, by the digital scale, a density of the drilling fluid at the surface.

8. A system of claim 1, wherein the system further comprises a plurality of annular pressure sensors positioned in a linear order in the borehole, wherein each of the first annular pressure sensor and the second annular pressure sensor are one of the plurality of annular pressure sensors, and wherein the first annular pressure sensor and the second annular pressure sensor also are positioned adjacent one another in the linear order in the borehole.

9. A system to detect and mitigate drill cuttings build-up in borehole drilling for hydrocarbon wells, the system comprising:

one or more processors;

two or more sensors in communication with the one or more processors and positioned in a borehole for a hydrocarbon well, a first sensor of the two or more sensors being positioned downhole from a second sensor of the two or more sensors in the borehole, the borehole extending from a surface into a subsurface; and non-transitory computer-readable medium in communication with the one or more processors and having one or more computer programs stored therein that, when executed by the one or more processors, cause the system to:

determine, when pumping a drilling fluid into the borehole, a first flowing pressure value at the first sensor and a second flowing pressure value at the second sensor, determine, when not pumping the drilling fluid in to the borehole, a first static pressure value at the first sensor and a second static pressure value at the second sensor;

compute one or more of:

a first decrease in pressure in the borehole between the first sensor and the second sensor that is attributable to build-up of drill cuttings between the first sensor and the second sensor thereby defining a first equivalent cuttings pressure loss calculated using values including: a true vertical depth value of each of the first sensor and the second sensor, a measured depth value of each of the first sensor and the second sensor, the first flowing pressure value, the second flowing pressure value, and a mud weight of the drilling fluid, a second decrease in pressure in the borehole between the first sensor and the second sensor that is attributable to build-up of drill cuttings between the first sensor and the second sensor thereby defining a second equivalent cuttings pressure loss calculated using values including: the true vertical depth value of the first sensor, the measured depth value of each of the first sensor and the second sensor, the first flowing pressure value, the second flowing pressure value, the second static pressure value, and the mud weight, and a third decrease in pressure in the borehole between the first sensor and the second sensor that is attributable to build-up of drill cuttings between the first sensor and the second sensor thereby defining a third equivalent cuttings pressure loss calculated using values including: the measured depth value of each of the first sensor and the second sensor, the first flowing pressure value, the second flowing pressure value, the first static pressure value, the second static pressure value, and a flow-in rate, and determine that drill cuttings limit fluid flow in an interval of the borehole between the first sensor and the second sensor responsive to determining one or more of the first equivalent cuttings pressure loss, the second equivalent cuttings pressure loss, and the third equivalent cuttings pressure loss.

10. A system of claim 9, wherein the system further comprises one or more displays in communication with the one or more processors, and wherein the one or more computer programs, when executed by the one or more processors, further cause the system to:

determine the true vertical depth value of each of the two or more sensors;

generate, by the one or more displays, a graphical representation of one or more of the first equivalent cuttings pressure loss, the second equivalent cuttings pressure loss, and the third equivalent cuttings pressure loss as a function of depth and time; and generate, by the one or more displays, a graphical representation of a caliper of the borehole as a function of depth.

11. A system of claim 10, wherein the one or more computer programs, when executed by the one or more processors, further cause the system to:

determine a predicted equivalent cuttings pressure loss for the borehole;

generate, by the one or more displays, a graphical representation of the predicted equivalent cuttings pressure loss for the borehole with the graphical representation of the one or more of the first equivalent cuttings pressure loss, the second equivalent cuttings pressure loss, and the third equivalent cuttings pressure loss; and determine that drill cuttings limit fluid flow in the interval of the borehole between the first sensor and the second sensor responsive to a comparison of the predicted equivalent cuttings pressure loss for the borehole to one or more of the first equivalent cuttings pressure loss, the second equivalent cuttings pressure loss, and the third equivalent cuttings pressure loss.

12. A system of claim 9, wherein the two or more sensors further include a third sensor, the second sensor being positioned downhole from the third sensor, wherein the first sensor and the second sensor are positioned adjacent each other in the borehole among the two or more sensors, wherein the second sensor and the third sensor are positioned adjacent each other in the borehole among the two or more sensors, and wherein the one or more computer programs, when executed by the one or more processors, further cause the system to:

determine, when pumping the drilling fluid into the borehole, a third flowing pressure value at the third sensor, determine one or more of:

a fourth decrease in pressure in the borehole between the second sensor and the third sensor that is attributable to build-up of drill cuttings between the second sensor and the third sensor thereby defining a fourth equivalent cuttings pressure loss responsive to: the true vertical depth value of the second sensor, a true vertical depth value of the third sensor, the measured depth value of the second sensor, a measured depth value of the third sensor, the second flowing pressure value, the third flowing pressure value, and the mud weight, a fifth decrease in pressure in the borehole between the second sensor and the third sensor that is attributable to build-up of drill cuttings between the second sensor and the third sensor thereby defining a fifth equivalent cuttings pressure loss responsive to: the true vertical depth value of each of the second sensor and the third sensor, the measured depth value of each of the second sensor and the third sensor, the second flowing pressure value, the third pressure value, and the mud weight, and a sixth decrease in pressure in the borehole between the second sensor and the third sensor that is attributable to build-up of drill cuttings between the second sensor and the third sensor thereby defining a sixth equivalent cuttings pressure loss responsive to: the true vertical depth value of each of the second sensor and the third sensor, the measured depth value of each of the second sensor and the third sensor, the second flowing pressure value, the third pressure value, the mud weight, and the flow-in rate, and determine that drill cuttings limit fluid flow in the interval of the borehole between the first sensor and the second sensor relative to another interval of the borehole between the second sensor and the third sensor responsive to comparing (i) one or more of the first equivalent cuttings pressure loss, the second equivalent cuttings pressure loss, and the third equivalent cuttings pressure loss to (ii) one or more of the fourth equivalent cuttings pressure loss, the fifth equivalent cuttings pressure loss, and the sixth equivalent cuttings pressure loss.

13. A system of claim 9, wherein the two or more sensors further include a third sensor and a fourth sensor, the third sensor being positioned downhole from the fourth sensor, and wherein the one or more computer programs, when executed by the one or more processors, further cause the system to:

determine, when pumping drilling fluid into the borehole, a third pressure value at the third sensor and a fourth pressure value at the fourth sensor, determine one or more of:

a fourth decrease in pressure in the borehole between the third sensor and the fourth sensor that is attributable to build-up of drill cuttings between the third sensor and the fourth sensor thereby defining a fourth equivalent cuttings pressure loss responsive to: a true vertical depth value of each of the third sensor and the fourth sensor, a measured depth value of each of the third sensor and the fourth sensor, the third pressure value, the fourth pressure value, and the mud weight, a fifth decrease in pressure in the borehole between the third sensor and the fourth sensor that is attributable to build-up of drill cuttings between the third sensor and the fourth sensor thereby defining a fifth equivalent cuttings pressure loss responsive to: the true vertical depth value of each of the third sensor and the fourth sensor, the measured depth value of each of the third sensor and the fourth sensor, the third pressure value, the fourth pressure value, and the mud weight, and a sixth decrease in pressure in the borehole between the third sensor and the fourth sensor that is attributable to build-up of drill cuttings between the third sensor and the fourth sensor thereby defining a sixth equivalent cuttings pressure loss responsive to: the true vertical depth value of each of the third sensor and the fourth sensor, the measured depth value of each of the third sensor and the fourth sensor, the third pressure value, the fourth pressure value, the mud weight, and the flow-in rate, and determine that drill cuttings limit fluid flow in the interval of the borehole between the first sensor and the second sensor relative to another interval of the borehole between the third sensor and the fourth sensor responsive to comparing (i) one or more of the first equivalent cuttings pressure loss, the second equivalent cuttings pressure loss, and the third equivalent cuttings pressure loss to (ii) one or more of the fourth equivalent cuttings pressure loss, the fifth equivalent cuttings pressure loss, and the sixth equivalent cuttings pressure loss.

14. A system of claim 13, wherein the two or more sensors are positioned in a linear order in the borehole, wherein the first sensor and the second sensor are positioned adjacent each other in the linear order, and wherein the third sensor and the fourth sensor are positioned adjacent each other in the linear order.

15. A method to detect and mitigate drill cuttings build-up m borehole drilling for hydrocarbon wells, the method comprising:

providing a drill cuttings monitor application to a user on a user computing device; and receiving measurements at a server from two or more sensors positioned in a borehole for a hydrocarbon well, a first sensor of the two or more sensors being positioned downhole from a second sensor of the two or more sensors in the borehole, the borehole extending from a surface into a subsurface, the server including one or more processors and a memory that stores the user's preferences for information format, the one or more processors operating to:

determine, responsive to the received measurements taken when pumping a drilling fluid into the borehole, a first flowing pressure value at the first sensor and a second flowing pressure value at the second sensor, determine, when not pumping the drilling fluid in to the borehole, a first static pressure value at the first sensor and a second static pressure value at the second sensor;

compute one or more of:

a first decrease in pressure in the borehole between the first sensor and the second sensor that is attributable to build-up of drill cuttings between the first sensor and the second sensor thereby defining a first equivalent cuttings pressure loss calculated using values including: a true vertical depth value of each of the first sensor and the second sensor, a measured depth value of each of the first sensor and the second sensor, the first flowing pressure value, the second flowing pressure value, and a mud weight of the drilling fluid, a second decrease in pressure in the borehole between the first sensor and the second sensor that is attributable to build-up of drill cuttings between the first sensor and the second sensor thereby defining a second equivalent cuttings pressure loss calculated using values including: the true vertical depth value of the first sensor, the measured depth value of each of the first sensor and the second sensor, the first flowing pressure value, the second flowing pressure value, the second static pressure value, and the mud weight, and a third decrease in pressure in the borehole between the first sensor and the second sensor that is attributable to build-up of drill cuttings between the first sensor and the second sensor thereby defining a third equivalent cuttings pressure loss calculated using values including: the measured depth value of each of the first sensor and the second sensor, the first flowing pressure value, the second flowing pressure value, the first static pressure value, the second static pressure value, and a flow-in rate, determine that drill cuttings limit fluid flow in an interval of the borehole between the first sensor and the second sensor responsive to determining one or more of the first equivalent cuttings pressure loss, the second equivalent cuttings pressure loss, and the third equivalent cuttings pressure loss, generate a drill cuttings alert from the one or more of the first equivalent cuttings pressure loss, the second equivalent cuttings pressure loss, and the third equivalent cuttings pressure loss, format the drill cuttings alert according to the information format, and transmit the formatted drill cuttings alert to the user computing device and thereby detect and mitigate drill cuttings build-up in the interval.

16. A method of claim 15, wherein the drill cuttings alert includes a graphical representation of one or more of the first equivalent cuttings pressure loss, the second equivalent cuttings pressure loss, and the third equivalent cuttings pressure loss as a function of one or more of time and depth in the borehole.

17. A method of claim 15, wherein the one or more processors further operate to determine a predicted equivalent cuttings pressure loss for the borehole, and wherein the formatted drill cuttings alert further includes a graphical representation of the predicted equivalent cuttings pressure loss for the borehole.

18. A method of claim 17, wherein the one or more processors further operate to:

determine that drill cuttings limit fluid flow in the interval of the borehole between the first sensor and the second sensor responsive to a comparison of the predicted equivalent cuttings pressure loss for the borehole to the equivalent cuttings pressure loss between the first sensor and the second sensor.

19. A method of claim 15, wherein a third sensor of the two or more sensors is positioned uphole from the second sensor in the borehole, wherein the one or more processors further operate to:

determine, responsive to the received measurements taken when pumping the drilling fluid into the borehole, a third pressure value at the third sensor;

determine one or more of:

a fourth decrease in pressure in the borehole between the second sensor and the third sensor that is attributable to build-up of drill cuttings between the second sensor and the third sensor thereby defining a fourth equivalent cuttings pressure loss responsive to: the true vertical depth value of the second sensor, a true vertical depth value of the third sensor, the measured depth value of the second sensor, a measured depth value of the third sensor, the second flowing pressure value, the third pressure value, and the mud weight, a fifth decrease in pressure in the borehole between the second sensor and the third sensor that is attributable to build-up of drill cuttings between the second sensor and the third sensor thereby defining a fifth equivalent cuttings pressure loss responsive to: the true vertical depth value of each of the second sensor and the third sensor, the measured depth value of each of the second sensor and the third sensor, the second flowing pressure value, the third pressure value, and the mud weight, and a sixth decrease in pressure in the borehole between the second sensor and the third sensor that is attributable to build-up of drill cuttings between the second sensor and the third sensor thereby defining a sixth equivalent cuttings pressure loss responsive to: the true vertical depth value of each of the second sensor and the third sensor, the measured depth value of each of the second sensor and the third sensor, the second flowing pressure value, the third pressure value, the mud weight, and the flow-in rate; and determine that drill cuttings limit fluid flow in the interval of the borehole between the first sensor and the second sensor relative to another interval of the borehole between the second sensor and the third sensor responsive to comparing (i) one or more of the first equivalent cuttings pressure loss, the second equivalent cuttings pressure loss, and the third equivalent cuttings pressure loss to (ii) one or more of the fourth equivalent cuttings pressure loss, the fifth equivalent cuttings pressure loss, and the sixth equivalent cuttings pressure loss;

wherein the formatted drill cuttings alert includes a graphical representation of equivalent cuttings pressure loss to enable the user to visually compare (i) one or more of the first equivalent cuttings pressure loss, the second equivalent cuttings pressure loss, and the third equivalent cuttings pressure loss to (ii) one or more of the fourth equivalent cuttings pressure loss, the fifth equivalent cuttings pressure loss, and the sixth equivalent cuttings pressure loss.

20. A method of claim 15, wherein a third sensor of the two or more sensors is positioned downhole from a fourth sensor of the two or more sensors in the borehole, and wherein the one or more processors further operate to:

determine, responsive to the received measurements taken when pumping the drilling fluid into the borehole, a third pressure value at the third sensor and a fourth pressure value at the fourth sensor, determine one or more of:

a fourth decrease in pressure in the borehole between the third sensor and the fourth sensor that is attributable to build-up of drill cuttings between the third sensor and the fourth sensor thereby defining a fourth equivalent cuttings pressure loss responsive to: a true vertical depth value of each of the third sensor and the fourth sensor, a measured depth value of each of the third sensor and the fourth sensor, the third pressure value, the fourth pressure value, and the mud weight, a fifth decrease in pressure in the borehole between the third sensor and the fourth sensor that is attributable to build-up of drill cuttings between the third sensor and the fourth sensor thereby defining a fifth equivalent cuttings pressure loss responsive to: the true vertical depth value of each of the third sensor and the fourth sensor, the measured depth value of each of the third sensor and the fourth sensor, the third pressure value, the fourth pressure value, and the mud weight, and a sixth decrease in pressure in the borehole between the third sensor and the fourth sensor that is attributable to build-up of drill cuttings between the third sensor and the fourth sensor thereby defining a sixth equivalent cuttings pressure loss responsive to: the true vertical depth value of each of the third sensor and the fourth sensor, the measured depth value of each of the third sensor and the fourth sensor, the third pressure value, the fourth pressure value, the mud weight, and the flow-in rate; and determine that drill cuttings limit fluid flow in the interval of the borehole between the first sensor and the second sensor relative to another interval of the borehole between the third sensor and the fourth sensor responsive to comparing (i) one or more of the first equivalent cuttings pressure loss, the second equivalent cuttings pressure loss, and the third equivalent cuttings pressure loss to (ii) one or more of the fourth equivalent cuttings pressure loss, the fifth equivalent cuttings pressure loss, and the sixth equivalent cuttings pressure loss;

wherein the formatted drill cuttings alert includes a graphical representation of equivalent cuttings pressure loss to enable the user to visually compare (i) one or more of the first equivalent cuttings pressure loss, the second equivalent cuttings pressure loss, and the third equivalent cuttings pressure loss to (ii) one or more of the fourth equivalent cuttings pressure loss, the fifth equivalent cuttings pressure loss, and the sixth equivalent cuttings pressure loss.

* * * * *